US011268228B2

(12) United States Patent
Han et al.

(10) Patent No.: US 11,268,228 B2
(45) Date of Patent: Mar. 8, 2022

(54) WASHING APPARATUS AND CONTROLLING METHOD THEREOF

(71) Applicant: Samsung Electronics Co., Ltd., Suwon-si (KR)

(72) Inventors: Sung Han, Suwon-si (KR); Gyu-Sung Na, Yongin-si (KR); Jeong Hoon Kang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 153 days.

(21) Appl. No.: 15/947,487

(22) Filed: Apr. 6, 2018

(65) Prior Publication Data

US 2019/0017210 A1 Jan. 17, 2019

(30) Foreign Application Priority Data

Jul. 14, 2017 (KR) ..... 10-2017-0089383

(51) Int. Cl.
*D06F 37/34* (2006.01)
*D06F 37/38* (2006.01)
(Continued)

(52) U.S. Cl.
CPC ..... *D06F 33/47* (2020.02); *D06F 37/38* (2013.01); *D06F 17/08* (2013.01); *D06F 23/02* (2013.01);
(Continued)

(58) Field of Classification Search
CPC ..... D06F 37/304; D06F 37/308; D06F 37/40; D06F 21/02; D06F 23/02; D06F 34/06;
(Continued)

(56) References Cited

U.S. PATENT DOCUMENTS 2,968,174 A * 1/1961 Bell ..... D06F 23/02 68/23.6
6,257,027 B1 * 7/2001 Imai ..... D06F 37/304 68/12.12
(Continued)

FOREIGN PATENT DOCUMENTS

EP 1734167 A1 * 12/2006 ..... D06F 39/088
EP 2824232 A1 1/2015
(Continued)

OTHER PUBLICATIONS

WO2015158044—Machine Translation (Year: 2015).*
(Continued)

*Primary Examiner* — Marc Lorenzi

(57) ABSTRACT

Disclosed herein is a washing apparatus includes a drum, a pulsator, a drum drive motor rotates the drum in a first direction or a second direction, a pulsator drive motor rotates the pulsator in the first direction or the second direction, and a controller controls the drum drive motor to rotate the drum in the first direction and to rotate the drum in the second direction when an operation period expires. When a drum drive current value is greater than a first reference current value during the first direction rotation of the drum, the controller controls the drum drive motor so that the drum drive motor stops rotating the drum in the first direction. When the operation period expires the controller controls the drum drive motor so that the drum is rotated in the second direction.

1 Claim, 20 Drawing Sheets

(51) Int. Cl.

| | |
|---|---|
| ***D06F 37/40*** | (2006.01) |
| ***D06F 33/47*** | (2020.01) |
| *D06F 23/02* | (2006.01) |
| *D06F 17/08* | (2006.01) |
| *D06F 37/20* | (2006.01) |
| *D06F 103/46* | (2020.01) |
| *D06F 105/46* | (2020.01) |
| *D06F 105/48* | (2020.01) |
| *D06F 105/58* | (2020.01) |
| *D06F 101/00* | (2020.01) |

(52) U.S. Cl.
CPC ..... *D06F 37/206* (2013.01); *D06F 2101/00* (2020.02); *D06F 2103/46* (2020.02); *D06F 2105/46* (2020.02); *D06F 2105/48* (2020.02); *D06F 2105/58* (2020.02)

(58) Field of Classification Search
CPC ..... D06F 34/08; D06F 34/10; D06F 37/04; D06F 37/22; D06F 37/306; D06F 37/34; D06F 37/38; D06F 2103/46; D06F 17/06; D06F 17/08; D06F 17/10
See application file for complete search history.

(56) References Cited

U.S. PATENT DOCUMENTS

| | | | | |
|---|---|---|---|---|
| 2015/0047219 | A1* | 2/2015 | Lee | D06F 33/00 34/282 |
| 2015/0061560 | A1 | 3/2015 | Lee et al. | |
| 2015/0121630 | A1 | 5/2015 | Lee et al. | |
| 2015/0240404 | A1* | 8/2015 | Kim | D06F 33/02 68/12.05 |
| 2016/0130739 | A1* | 5/2016 | Song | D06F 37/40 8/137 |
| 2016/0251794 | A1 | 9/2016 | Kim et al. | |

FOREIGN PATENT DOCUMENTS

| | | | | | |
|---|---|---|---|---|---|
| JP | 2009142612 | A | * | 7/2009 | |
| KR | 10-1999-0076570 | A | | 10/1999 | |
| KR | 10-2005-0121016 | A | | 12/2005 | |
| KR | 10-2011-0089988 | A | | 8/2011 | |
| WO | WO-2015158044 | A1 | * | 10/2015 | D06F 23/02 |

OTHER PUBLICATIONS

JP2009142612—Machine Translation (Year: 2009).*
European Search Report dated Aug. 9, 2018 in connection with European Patent Application No. 18 15 6462, 9 pages.
Notice of Preliminary Rejection dated Sep. 8, 2021, in connection with Korean Application No. 10-2017-0089383, 13 pages.

* cited by examiner

WASHING APPARATUS AND CONTROLLING METHOD THEREOF

CROSS-REFERENCE TO RELATED APPLICATION(S) AND CLAIM OF PRIORITY

This application is related to and claims priority to Korean Patent Application No. 10-2017-0089383, filed on Jul. 14, 2017, the contents of which are incorporated herein by reference.

TECHNICAL FIELD

Embodiments of the present disclosure relate to a washing apparatus, more particularly to a washing apparatus capable of driving a drum and a pulsator independently of each other.

BACKGROUND

Generally, a washing apparatus is an apparatus that washes laundry by rotating a cylindrical rotating tub in which laundry is placed.

The types of the washing apparatus include a washing apparatus that washes laundry by lifting the laundry along an inner circumferential surface of a drum and dropping the laundry when the drum is horizontally disposed and rotates about a horizontal axis, and a washing apparatus that washes laundry using a water flow generated by a pulsator when a drum with the pulsator is vertically disposed in the washing apparatus and rotates about a vertical axis. The washing apparatus in which the drum is horizontally disposed is referred to as a front loading washing apparatus since a laundry inlet is formed in a front side of the washing apparatus, and the washing apparatus in which the drum is vertically disposed is referred to as a top loading washing apparatus since a laundry inlet is formed in an upper portion of the washing apparatus.

Generally, a washing apparatus washes laundry by employing any one method of the above mentioned two methods.

SUMMARY

To address the above-discussed deficiencies, it is a primary object to provide a front loading washing apparatus provided with a drum and a pulsator.

It is another aspect of the present disclosure to provide a washing apparatus capable of preventing the overload of a motor configured to drive a drum and a motor configured to drive a pulsator.

Additional aspects of the present disclosure will be set forth in part in the description which follows and, in part, will be obvious from the description, or may be learned by practice of the present disclosure.

In accordance with one aspect of the present disclosure, a washing apparatus includes a drum configured to be rotatable, a pulsator configured to be rotatable inside of the drum, a drum drive motor configured to rotate the drum in a first direction or a second direction, a pulsator drive motor configured to rotate the pulsator in the first direction or the second direction, and a controller configured to control the drum drive motor so that the drum is rotated in the first direction, and when an operation period is expired since the first direction rotation of the drum, configured to control the drum drive motor so that the drum is rotated in the second direction. When a drum drive current value, which is supplied to the drum drive motor, is greater than a first reference current value during the first direction rotation of the drum, the controller may control the drum drive motor so that the drum drive motor stops rotating the drum in the first direction. Further, when the operation period is expired since the first direction rotation of the drum, during the first direction rotation of the drum is stopped, the controller may control the drum drive motor so that the drum is rotated in the second direction.

The controller may control the pulsator drive motor so that the pulsator drive motor rotates the pulsator in the second direction during the controller controls the drum drive motor so that the drum drive motor rotates the drum in the first direction. Further, when the operation period is expired since the second direction rotation of the pulsator, the controller may control the pulsator drive motor so that the pulsator is rotated in the first direction.

When the drum drive current value, which is supplied to the drum drive motor, is greater than the first reference current value during the first direction rotation of the drum, the controller may control the pulsator drive motor so that the pulsator drive motor stops rotating the pulsator in the second direction.

When the operation period is expired since the second direction rotation of the pulsator, during the second direction rotation of the pulsator is stopped, the controller may control the pulsator drive motor so that the pulsator is rotated in the first direction.

When the pulsator drive current value, which is supplied to the pulsator drive motor, is greater than the second reference current value during the second direction rotation of the pulsator, the controller may control the pulsator drive motor so that the pulsator drive motor stops rotating the pulsator in the second direction.

When the operation period is expired since the second direction rotation of the pulsator, during the second direction rotation of the pulsator is stopped, the controller may control the pulsator drive motor so that the pulsator is rotated in the first direction.

The controller may control the pulsator drive motor so that the pulsator is rotated in the first direction during the controller controls the drum drive motor so that the drum is rotated in the first direction. Further, when the operation period is expired since the first direction rotation of the pulsator, the controller may control the pulsator drive motor so that the pulsator is rotated in the second direction.

The controller may control the drum drive motor and the pulsator drive motor so that a first rotational speed of the pulsator is greater than a first rotational speed of the drum.

In accordance with one aspect of the present disclosure, a control method of a washing apparatus, provided with a drum configured to be rotatable and a pulsator configured to be rotatable inside of the drum, includes rotating the drum in a first direction, rotating the drum in a second direction when an operation period is expired since the first direction rotation of the drum, stopping rotating the drum in the first direction when a drum drive current value, which is supplied to the drum drive motor, is greater than a first reference current value during the first direction rotation of the drum, and rotating the drum in the second direction when the operation period is expired since the first direction rotation of the drum, during the first direction rotation of the drum is stopped.

The method may further include rotating the pulsator in the second direction while rotating the drum in the first direction, and rotating the pulsator in the first direction when the operation period is expired since the second direction rotation of the pulsator.

The method may further include stopping rotating the pulsator in the second direction when the drum drive current value, which is supplied to the drum drive motor, is greater than the first reference current value during the first direction rotation of the drum.

The method may further include rotating the pulsator in the first direction when the operation period is expired since the second direction rotation of the pulsator, during the second direction rotation of the pulsator is stopped.

The method may further include stopping rotating the pulsator in the second direction when a pulsator drive current value, which is supplied to the pulsator drive motor, is greater than a second reference current value during the second direction rotation of the pulsator.

The method may further include rotating the pulsator in the first direction when the operation period is expired since the second direction rotation of the pulsator, during the second direction rotation of the pulsator is stopped.

The method may further include rotating the pulsator in the first direction while rotating the drum in the first direction, and rotating the pulsator in the second direction when the operation period is expired since the first direction rotation of the pulsator.

A first rotational speed of the pulsator is greater than a first rotational speed of the drum.

In accordance with one aspect of the present disclosure, a washing apparatus includes a drum configured to be rotatable, a pulsator configured to be rotatable inside of the drum, a drum drive motor configured to rotate the drum, a pulsator drive motor configured to rotate the pulsator, and a controller configured to control the drum drive motor so that the drum is rotated, and configured to control the pulsator drive motor so that the pulsator is rotated. Further, when a drum drive current value, which is supplied to the drum drive motor, is greater than a first reference current value during the rotation of the drum, the controller may control the drum drive motor and the pulsator drive motor so that the rotation of the drum and the rotation of the pulsator are stopped.

When a pulsator drive current value, which is supplied to the pulsator drive motor, is greater than a second reference current value during the rotation of the pulsator, the controller may control the drum drive motor so that the rotation of the drum is maintained and the controller controls the pulsator drive motor so that the rotation of the pulsator is stopped.

The control may control the pulsator drive motor so that the pulsator is rotated in the second direction while controlling the drum drive motor so that the drum is rotated in the first direction. Further, the control may control the pulsator drive motor so that the pulsator is rotated in the first direction while controlling the drum drive motor so that the drum is rotated in the second direction.

The control may control the drum drive motor and the pulsator drive motor so that the drum and the pulsator are alternately rotated in the first direction and the second direction.

Before undertaking the DETAILED DESCRIPTION below, it may be advantageous to set forth definitions of certain words and phrases used throughout this patent document: the terms "include" and "comprise." as well as derivatives thereof, mean inclusion without limitation; the term "or," is inclusive, meaning and/or; the phrases "associated" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, s as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
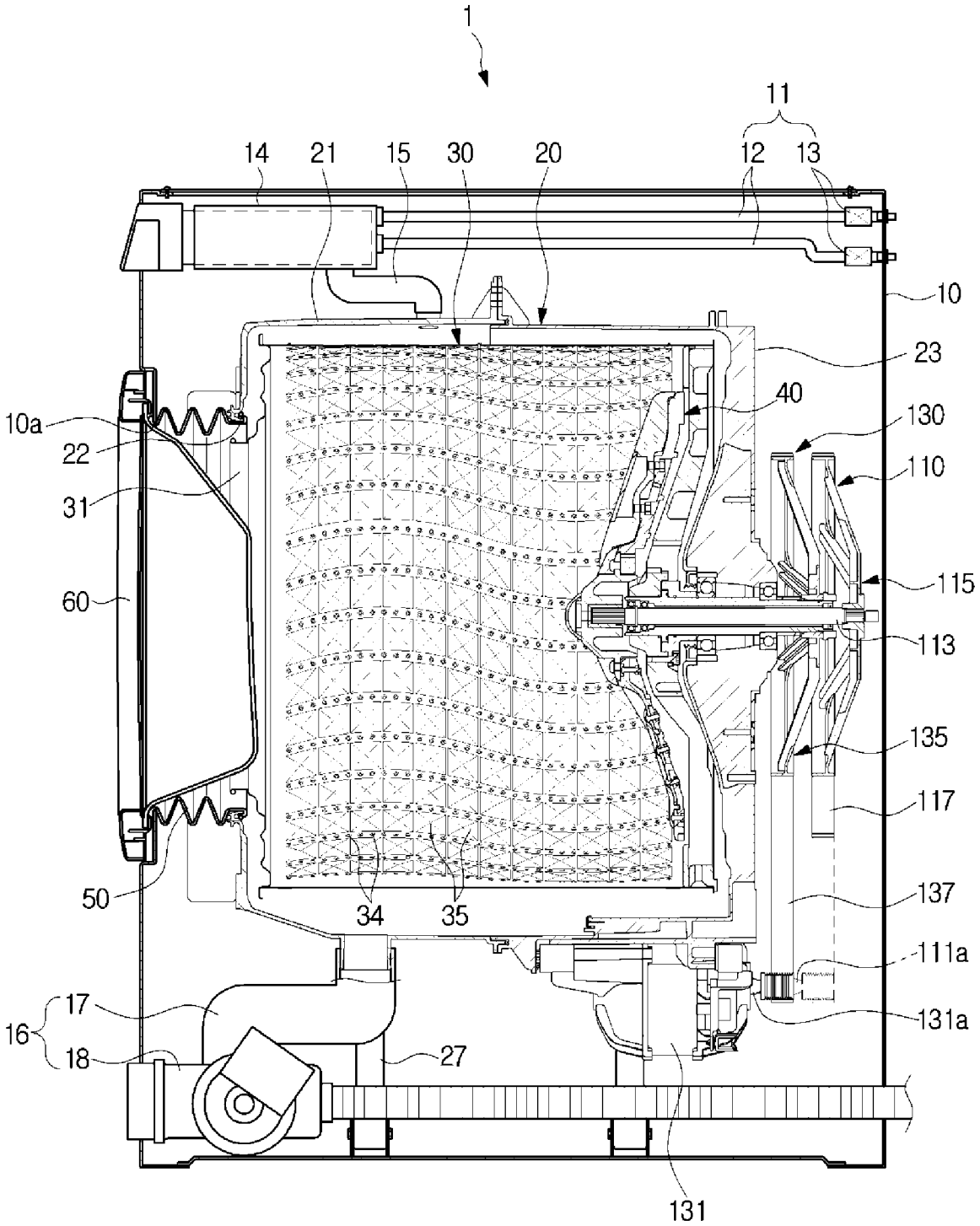
FIG. 1 is a view illustrating a configuration of a washing apparatus in accordance with an embodiment of the present disclosure.

FIGS. 1 through 20, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

The present disclosure will be described more fully hereinafter with reference to the accompanying drawings.

FIG. 1 is a view illustrating a configuration of a washing apparatus in accordance with an embodiment of the present disclosure.

Referring to FIG. 1, a washing apparatus 1 may include a body 10 configured to form an appearance of the washing apparatus 1 and configured to accommodate components of the washing apparatus 1 therein, a tub 20 provided in the body 10 to accommodate water, a drum 30 configured to accommodate laundry and configured to rotate, a pulsator 40 provided in the drum 30, a first drive device 110 configured to drive the pulsator 40 and a second drive device 130 configured to drive the drum 30.

The body 10 may be formed in an approximately box shape. The body 10 may include a front plate, a rear plate, an upper plate, a bottom plate and a side plate. On the front plate, a laundry inlet 10*a* may be provided to put laundry into the inside of the drum 30.

The laundry inlet 10*a* of the body 10 may be opened or closed by a door 60. The door 60 may be rotatably coupled to the body 10 by a hinge member. The door 60 may be configured with a glass member and a door frame configured to support the glass member.

The glass member may be formed of a transparent tempered glass to allow a user to see the inside of the body 10. The glass member may protrude to the inside of the tub 20 to prevent laundry from being concentrated in the side of the door 60.

The tub 20 may store water and be formed in a substantially cylindrical shape. The tub 20 may be supported by a suspension device 27. The tub 20 may include a front portion 21 provided with a hollow, an opening 22 formed in one side of the front portion 21 to correspond to the laundry inlet 10*a* of the body 10, and a rear portion 23 formed in the other side of the front portion 21.

A reinforcing rib 24 (refer to FIG. 2) in a grid type may be formed on the rear portion 23 of the tub 20 while maintaining a constant space along the radial direction and the circumferential direction. The reinforcing ribs 24 may prevent the tub 20 from bending when the tub 20 is injected, and prevent the rear wall of the tub 20 from twisting due to a load, which is transmitted to the tub 20 upon the washing or the spin-dry.

The laundry inlet 10*a* of the front portion of the body 10 may be connected to the opening 22 of the tub 20 through a diaphragm 50. The diaphragm 50 forms a passage connecting the laundry inlet 10*a* of the front portion of the body 10 to the opening 22 of the tub 20 to guide laundry that is input via the laundry inlet 10*a*, to the inside of the drum 30. In addition, the diaphragm 50 may reduce a vibration that is transmitted to the body 10 upon the rotation of the drum 30. The diaphragm 50 may perform sealing between the tub 20 and the glass member of the door 60.

The drum 30 may have a substantially cylindrical shape having a front surface open and the drum 30 may be rotatably provided inside the tub 20. The drum 30 may include an opening 31 formed on the front surface of the drum 30. The drum 30 may be disposed such that a central axis thereof is parallel to a central axis of the tub 20.

The drum 30 may rotate inside the tub 20. The drum 30 may perform washing by lifting and lowering the laundry while the drum 30 rotates.

A plurality of through holes 34 may be formed around the circumference of the drum 30 to allow the water stored in the tub 20 to flow. In addition, at least one protrusion 35 protruding through the inside of the drum 30 may be provided around the circumference of the drum 30. When the laundry is washed, the protrusions 35 may rub the laundry to improve the washing performance.

The plurality of through holes 34 and/or the protrusion 35 may be continuously provided in the circumferential surface of the drum 30. In addition, a lifter may be provided in a part of the inner circumferential surface of the drum 30 to lift the laundry.

The pulsator 40 may be disposed in the inner side of the rear side of the drum 30 and rotatably installed with respect to the drum 30. The pulsator 40 may be configured to be rotatable independently of the drum 30. That is, the pulsator 40 may rotate in the same direction as the drum 30, or may rotate in a different direction from the drum 30. The rotation axis of pulsator 40 may be the same as the rotation axis of drum 30.

During the washing is performed, the pulsator 40 may generate a water flow in the forward and backward directions inside the drum 30. According to an embodiment, it may be possible to improve the washing performance by the pulsator 40.

A water supply device 11 supplying water to the inside of the tub 20 may be installed at an upper portion of the tub 20. The water supply device 11 may be configured with a water supply pipe 12 configured to supply water from an external water source and a water supply valve 13 configured to open and close the water supply pipe 12.

A detergent supply device 14 configured to supply detergent to the tub 20 may be provided in the front upper portion of the body 10. The detergent supply device 14 may be connected to the tub 20 via a connection pipe 15. Water supplied through the water supply pipe 12 may be supplied to the inside of the tub 20 together with the detergent by passing through the detergent supply device 14.

The washing apparatus 1 may include a discharge device 16 configured to discharge water of the tub 20. The discharge device 16 may be configured with a discharge pipe 17 connected to the lower portion of the tub 20 to guide the water to the outside of the body 10, and a drain pump 18 configured to pump the water of the tub 20.

Figure 2:
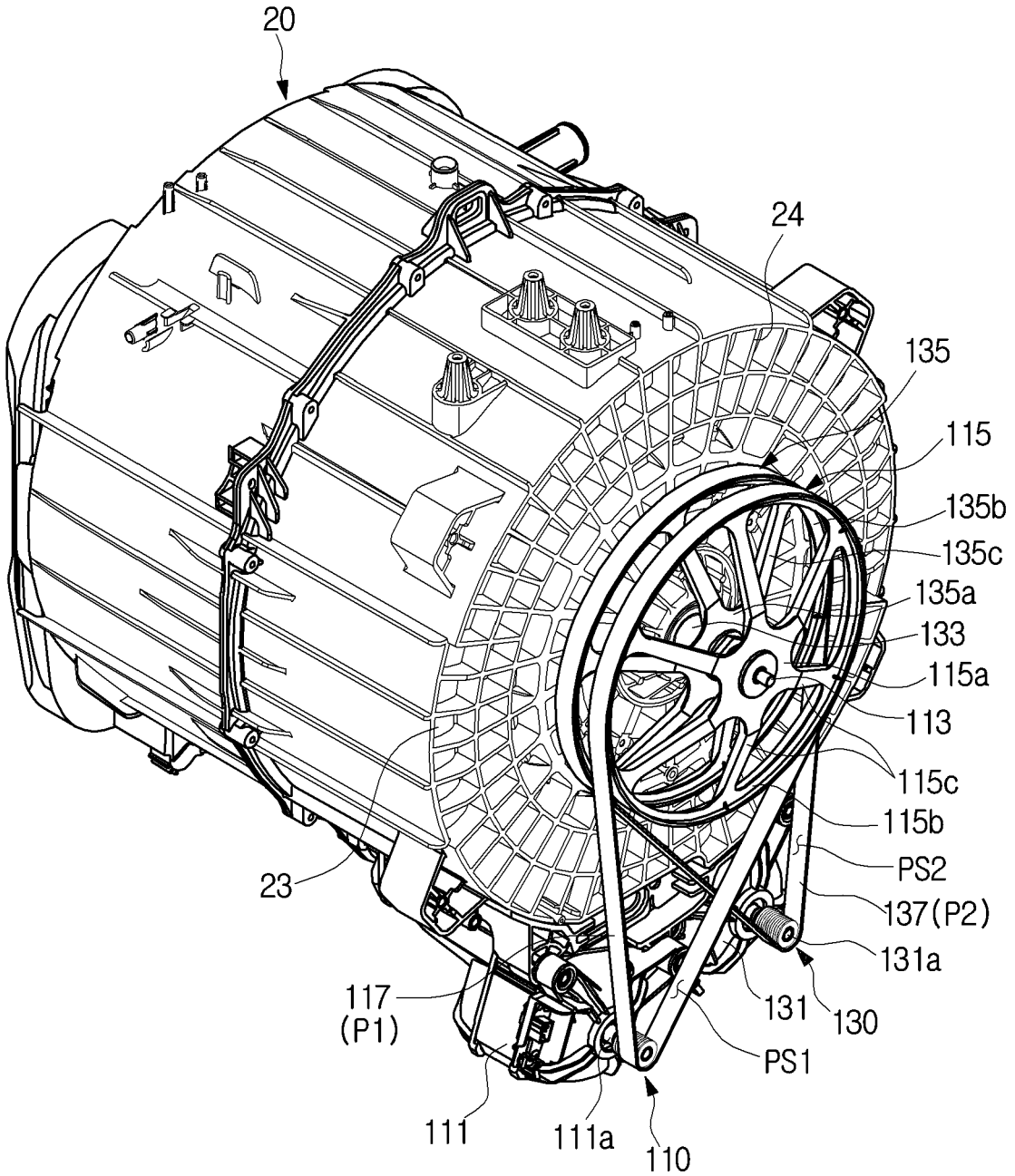
FIG. 2 is a view illustrating a tub and a drive device of the washing apparatus in accordance with an embodiment.
Figure 3:
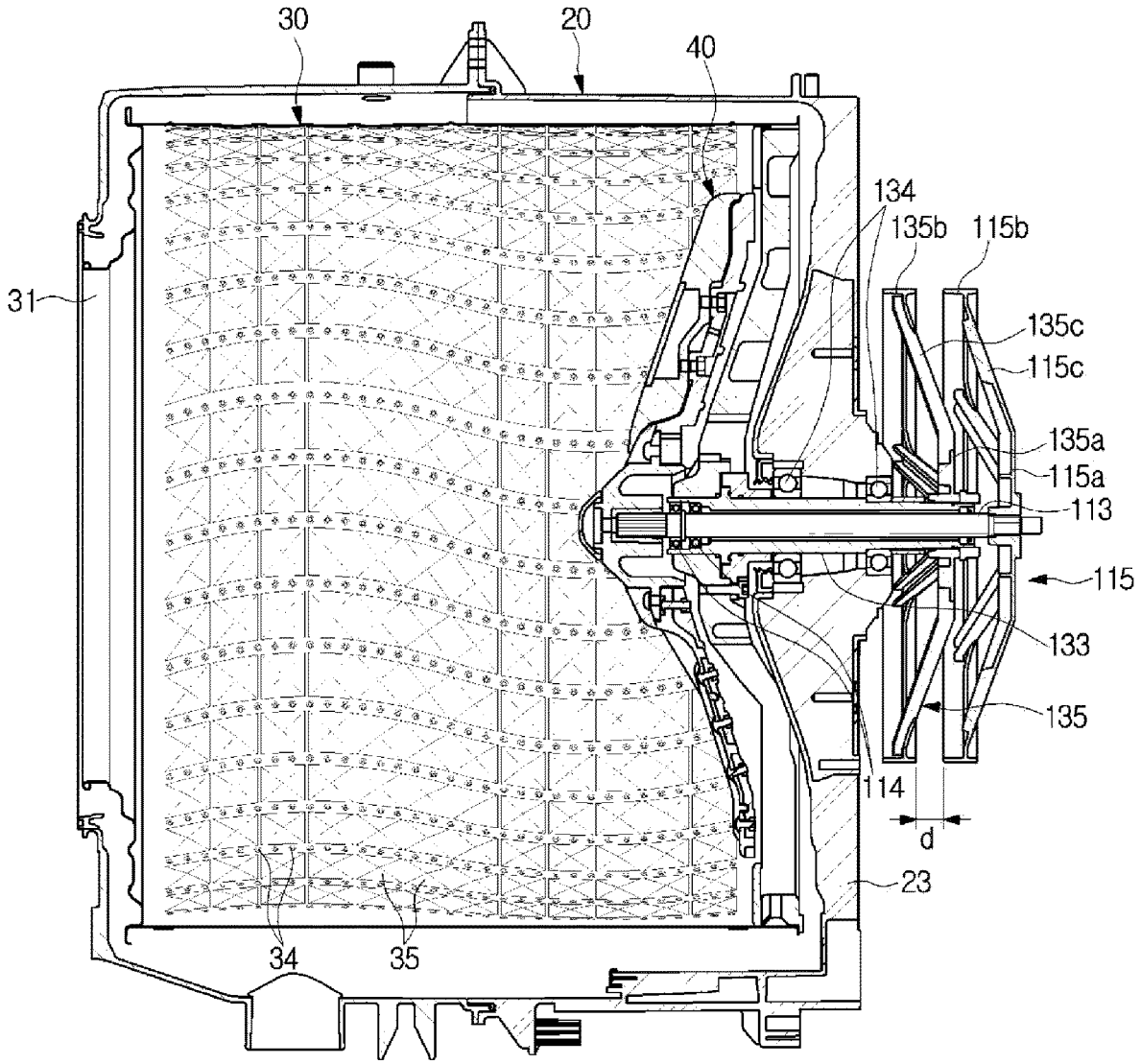
FIG. 3 is a view illustrating the tub, a pulsator and the drive device of the washing apparatus in accordance with an embodiment.
Figure 4:
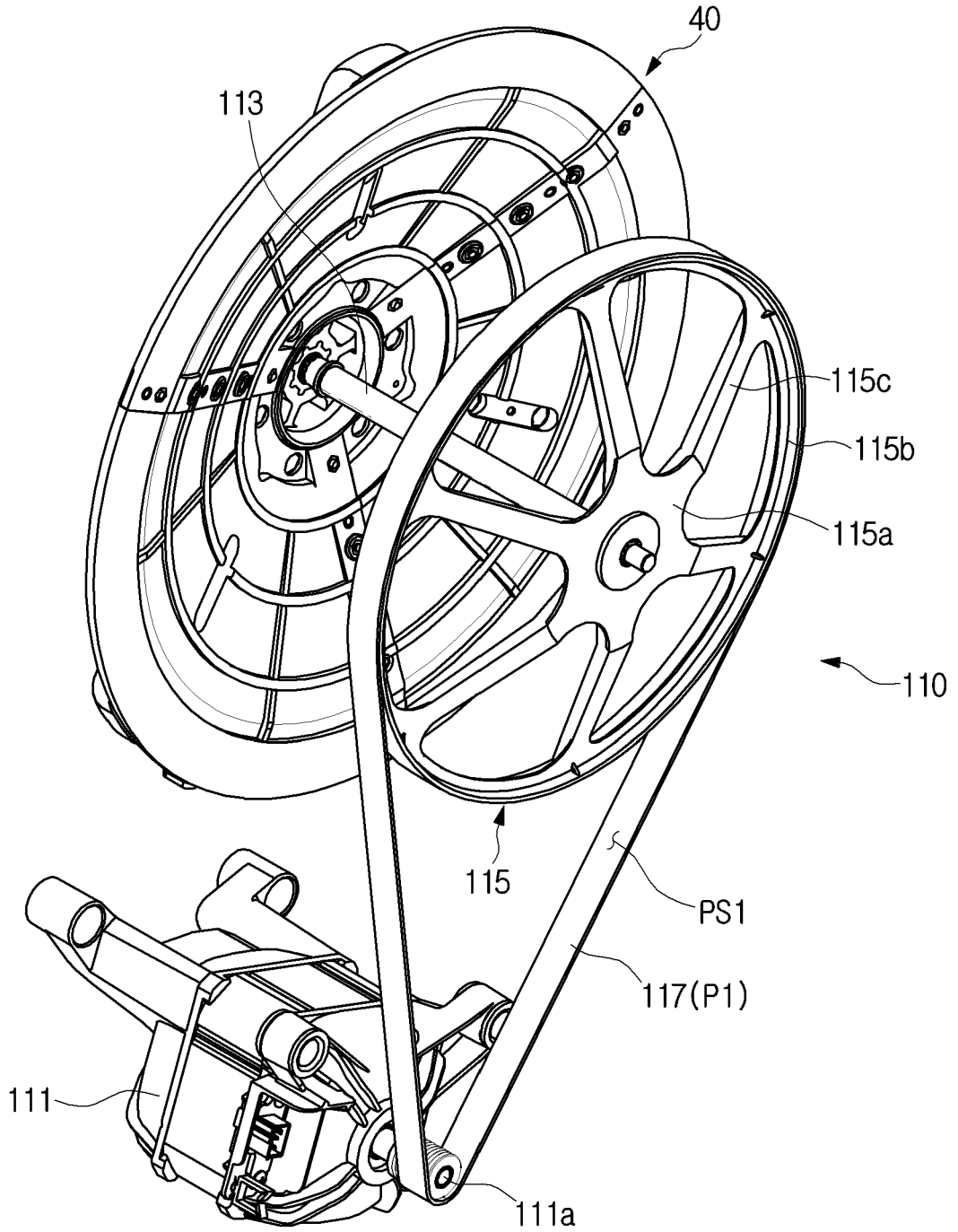
FIG. 4 is a view illustrating the pulsator and a first drive device of the washing apparatus in accordance with an embodiment.
Figure 5:
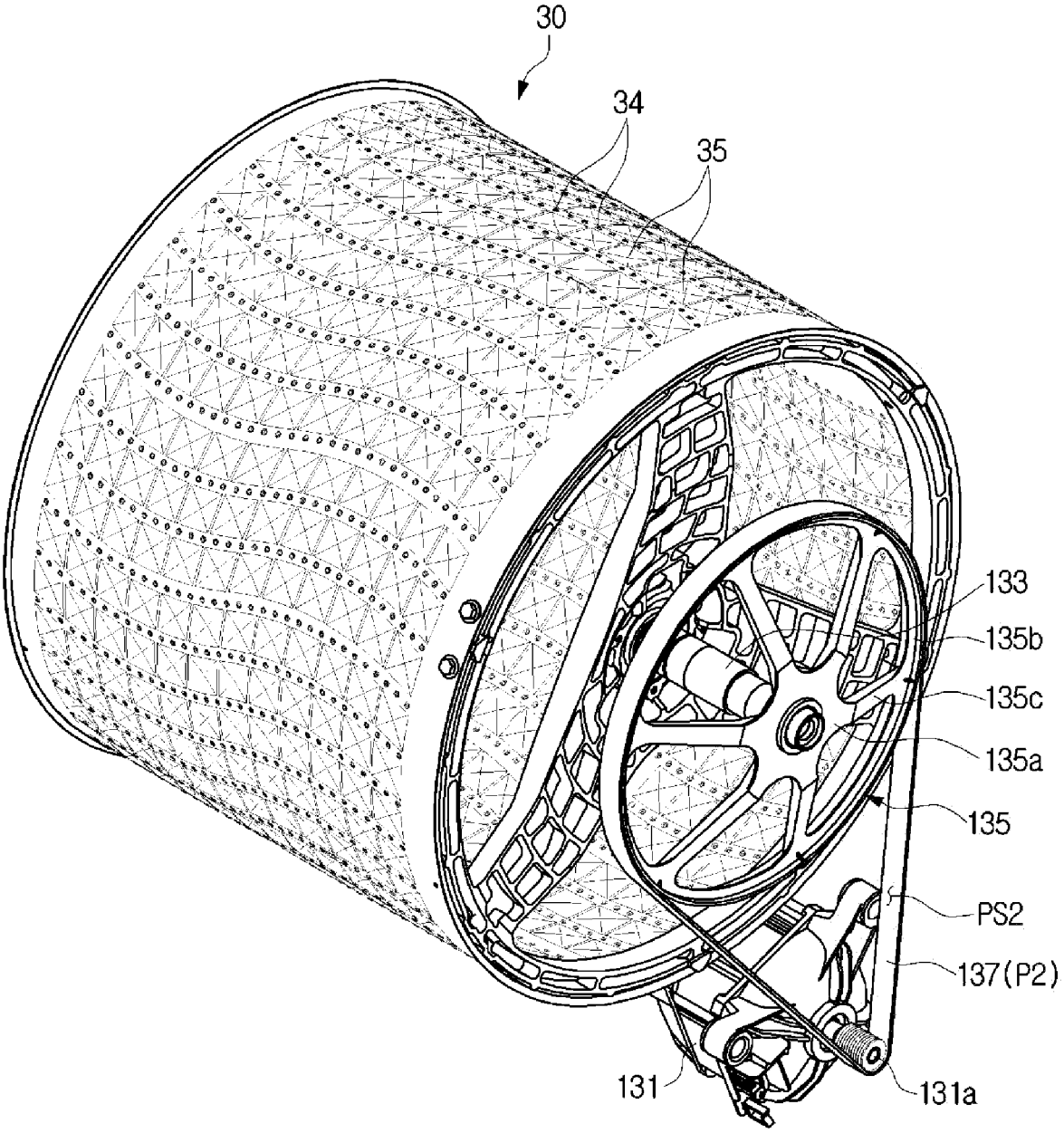
FIG. 5 is a view illustrating the drum and a second drive device of the washing apparatus in accordance with an embodiment.
Figure 6:
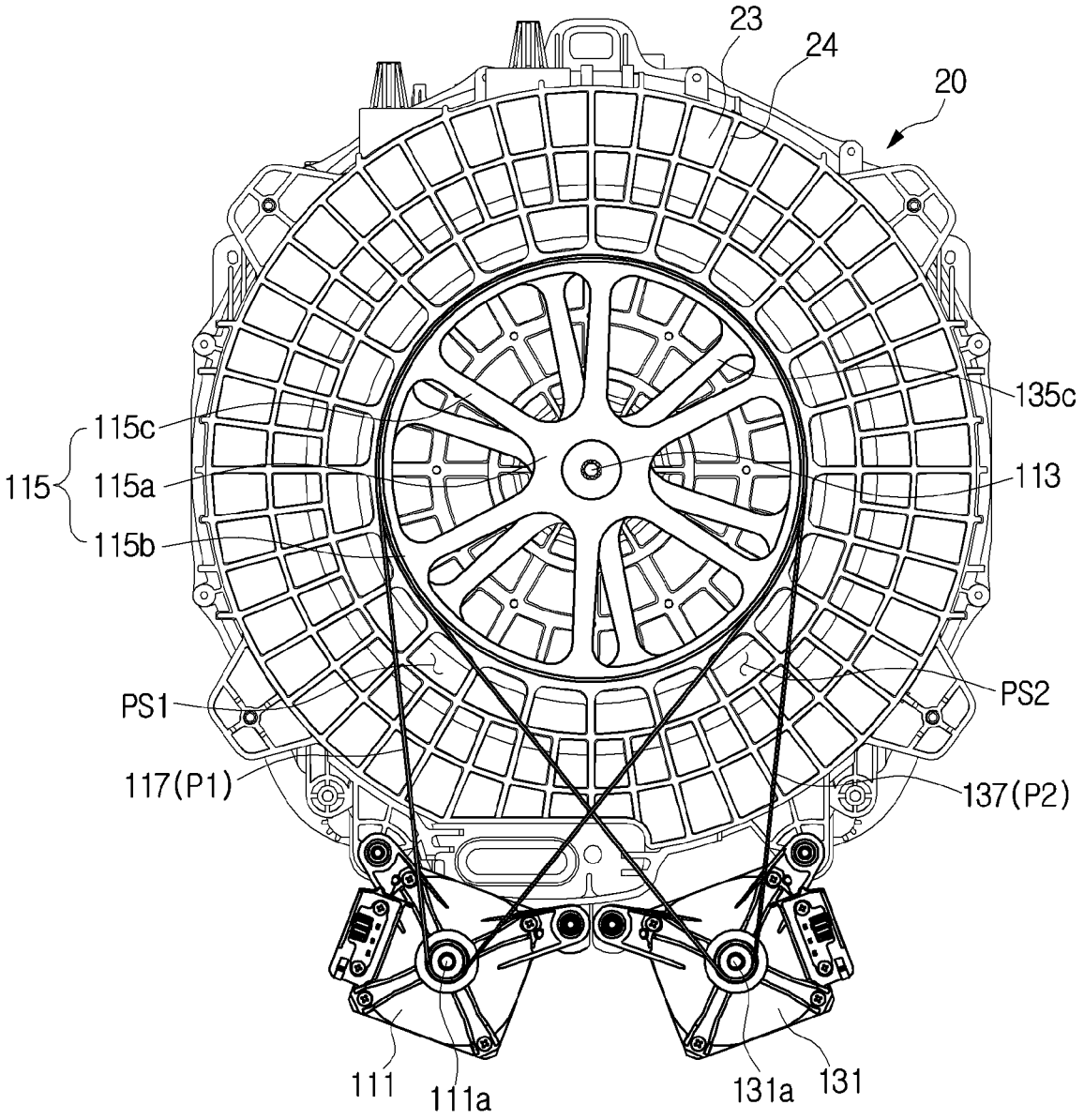
FIG. 6 is a view illustrating a rear surface of the tub and the drive device of the washing apparatus in accordance with an embodiment.

FIG. 2 is a view illustrating a tub and a drive device of the washing apparatus in accordance with an embodiment. FIG. 3 is a view illustrating the tub, a pulsator and the drive device of the washing apparatus in accordance with an embodiment. FIG. 4 is a view illustrating the pulsator and a first drive device of the washing apparatus in accordance with an embodiment. FIG. 5 is a view illustrating the drum and a second drive device of the washing apparatus in accordance with an embodiment. FIG. 6 is a view illustrating a rear surface of the tub and the drive device of the washing apparatus in accordance with an embodiment.

Referring to FIGS. 2 to 6, a drive device 130 including a first drive device 110 configured to rotate the pulsator 40, and a second drive device 130 configured to rotate the drum 30 may be provided in the rear side of the tub 20.

The first drive device 110 may include a first drive motor 111 configured to generate a rotational force to rotate the pulsator 40, a first shaft 113 configured to be extended to the rear side from the pulsator 40 to become a rotation axis of the pulsator 40, a first pulley 115 connected to the first shaft 113, and a first belt 117 configured to connect the first drive motor 111 to the first pulley 115.

The first drive motor 111 may be fixed to the outside of the tub 20 and supply the rotational force to the pulsator 40. Particularly, the first drive motor 111 may be mounted on a part of the lower end portion of the outer circumferential surface of the tub 20.

The first drive motor 111 may include a first motor shaft 111*a*, wherein the first motor shaft 111*a* may be configured to be more extended to the rear side of the body 10 than a second motor shaft 131*a* of a second drive motor 131 described later. By using the above mentioned configuration, a first rotation path (P1) formed by the first belt 117 connected to the first motor shaft 111*a* may be not overlapped with a second rotation path (P2) formed by a second belt 137 connected to the second motor shaft 131*a*. In other words, the first belt 117 may be arranged so as not to interfere with the second belt 137.

The first drive motor 111 may be a motor capable of forward rotation (e.g., clockwise rotation) and reverse rotation (e.g., counterclockwise rotation). The first drive motor 111 may rotate the pulsator 40 in a direction the same direction as a rotation direction of the drum 30 or in a direction opposite to the rotation direction of the drum 30.

The first drive motor 111 may employ any one of direct current (DC) motor, brushless direct current (BLDC) motor, induction motor, or permanent magnet synchronous (PMSM) motor.

The first shaft 113 may be connected to a rear surface of the pulsator 40 and extended from the pulsator 40 along the rotation axis of the pulsator 40. That is, the first shaft 113 may be extended to the rear side of the pulsator 40. The first shaft 113 may become the rotation axis of the pulsator 40. The first shaft 113 may penetrate the rear plate of the tub 20 and then connect the pulsator 40 to the first pulley 115. The first shaft 113 may be formed separately from the pulsator 40 and then coupled to the pulsator 40, but is not limited thereto. The first shaft 113 may be integrally formed with the pulsator 40.

A first bearing 114 configured to rotatably support the first shaft 113 may be provided on the outer circumferential surface of the first shaft 113. The first bearing 114 may be fixed to a second shaft 133.

One end of the first shaft 113 may be connected to the pulsator 40 and the other end of the first shaft 113 may be connected to a first pulley 115 described later. By using the structure, the first pulley 115 may receive the rotational force from the first drive motor 111 and the first shaft 113 connected to the first pulley 115 may transmit the rotational force to the pulsator 40 so as to rotate the pulsator 40.

The first shaft 113 may be rotatably inserted into the second shaft 133. Accordingly, the first shaft 113 may rotate in the same direction as the second shaft 133, or may rotate in the opposite direction to the second shaft 133.

Since the first shaft 113 is longer than the second shaft 133, the first shaft 113 may be inserted into the second shaft 133 so as to protrude from both ends of the second shaft 133. According to this configuration, the pulsator 40 connected to one end of the first shaft 113 may be disposed inside the drum 30 connected to one end of the second shaft 133. The first pulley 115 connected to the other end of the first shaft 113 may be disposed further from the drum 30 than the second pulley 135 connected to the other end of the second shaft 133.

The first pulley 115 may be connected to the other end portion of the first shaft 113, which is opposite to one end portion of the first shaft 113 to which the pulsator 40 is connected. The first pulley 115 may include a first base portion 115*a* connected to the first shaft 113, a first coupling portion 115*b* coupled to the first belt 117 described later, to guide the rotation of the first belt 117, and a first extension portion 115*c* configured to connect the first base portion 115*a* to the first coupling portion 115*b*.

The first base portion 115*a* may be fixed to the other end portion of the first shaft 113, and configured to allow the first shaft 113 to rotate together with the first pulley 115 upon the rotation of the first pulley 115.

The first coupling portion 115*b* may be disposed in a circumference of the first pulley 115, and then connected to the first belt 117. As the first coupling portion 115*b* is connected to the first belt 117, the first pulley 115 may receive the rotational force of the first drive motor 111 through the first belt 117. The first pulley 115 may transmit the rotational force, which is received via the first coupling portion 115*b*, to the first shaft 113 connected to the first base portion 115*a*.

The first extension portion 115*c* may include at least one spoke along a radial direction of the first shaft 113 to connect the first base portion 115*a* to the first coupling portion 115*b*. However, although it is different from that shown in FIG. 4, the first extension portion 115*c* may include a single plate extended from the first base portion 115*a* to the first coupling portion 115*b*. The first extension portion 115*c* may transmit the rotational force, received from the first drive motor 111 by the first coupling portion 115*b*, to the first base portion 115*a*.

The first pulley 115 may receive the rotational force from the first drive motor 111 and transmit the rotational force to the pulsator 40. The first pulley 115 may be disposed further from the drum 30 than the second pulley 135 described below.

The first belt 117 may connect the first drive motor 111 to the first pulley 115 to transmit the rotational force of the first drive motor 111 to the first pulley 115. Particularly, the inner surface of the first belt 117 may be brought into contact with and coupled to the first motor shaft 111*a* of the first drive motor 111 and the first coupling portion 115*b* of the first pulley 115. That is, the first belt 117 may be rotated by the first motor shaft 111*a* of the first drive motor 111 and the first coupling portion 115*b* of the first pulley 115.

The first belt 117 may be spaced apart from the second belt 137 by a predetermined distance (d). Accordingly, the second belt 137 may not be interfered with the first belt 117.

The second drive device 130 may include a second drive motor 131 configured to generate a rotational force to rotate the drum 30, a second shaft 133 configured to be extended to the rear side from the drum 30 to become a rotation axis of the drum 30, a second pulley 135 connected to the second shaft 133, and a second belt 137 configured to connect the second drive motor 131 to the second pulley 135.

The second drive motor 131 may be fixed to the outside of the tub 20 and supply the rotational force to the drum 30. Particularly, the second drive motor 131 may be mounted on a part, which is different from a part of the lower end portion of the outer circumferential surface of the tub 20 to which the first drive motor 111 is fixed.

The second drive motor 131 may include a second motor shaft 131*a*, wherein the second motor shaft 131*a* may be configured to be less extended to the rear side of the body 10 than the first motor shaft 111*a* of the first drive motor 111. By using the above mentioned configuration, the second rotation path (P2) formed by the second belt 137 connected to the second motor shaft 131*a* may be not overlapped with the first rotation path (P1) formed by the first belt 117 connected to the first motor shaft 111*a*. In other word, the second belt 137 may be arranged so as not to interfere with the first belt 117.

Particularly, a first rotation plane (PS1) formed by the first belt 117 may be not overlapped with a second rotation plane (PS2) formed by the second belt 137, and the first rotation plane (PS1) and second rotation plane (PS2) may be approximately parallel to each other.

In the same as the first drive motor 111, the second drive motor 131 may be a motor capable of forward rotation (e.g., clockwise rotation) and reverse rotation (e.g., counterclockwise rotation). The second drive motor 131 may rotate the drum 30 in a first direction or in a second direction different from the first direction.

The second drive motor 131 may employ any one of direct current (DC) motor, brushless direct current (BLDC) motor, induction motor, or permanent magnet synchronous (PMSM) motor The second drive motor 131 may be a drive motor the same as the first drive motor 111. Particularly, the second drive motor 131 may be configured to have a driving force the same as the driving force of the first drive motor 111.

The second shaft 133 may be connected to a rear surface of the drum 30 and extended from the drum 30 along the rotation axis of the drum 30. That is, the second shaft 133 may be extended to the rear side of the drum 30. The second shaft 133 may become the rotation axis of the drum 30. The second shaft 133 may penetrate the rear plate of the tub 20 and then connect the drum 30 to the second pulley 135. The second shaft 133 may be formed separately from the drum 30 and then coupled to the drum 30, but is not limited thereto. Alternatively, the second shaft 133 may be integrally formed with the drum 30.

A second bearing 134 configured to rotatably support the second shaft 133 may be provided on the outer circumferential surface of the second shaft 133. The second bearing 134 may be fixed to the tub 20.

One end of the second shaft 133 may be connected to the drum 30 and the other end of the second shaft 133 may be connected to the second pulley 135 described later. According to the configuration, the second pulley 135 may receive the rotational force from the second drive motor 131 and the second shaft 133 connected to the second pulley 135 may transmit the rotational force to the drum 30 so as to rotate the drum 30.

The second shaft 133 may have a hollow therein so that the first shaft 113 is rotatably inserted therein. Particularly, the hollow of the second shaft 133 may be formed to have a certain diameter, which is larger than a diameter of the first shaft 113 by a predetermined size, so that the first shaft 113 can be inserted into the hollow of the second shaft 133 and rotate. According to this configuration, the second shaft 133 may rotate in the same direction as the first shaft 113, or may rotate in the opposite direction to the first shaft 113.

The second shaft 133 may be shorter than the first shaft 113 so that the first shaft 113 protrudes from both ends of the second shaft 133. According to this configuration, the rear plate of the drum 30 connected to one end of the second shaft 133 may be disposed in more rear side than the pulsator 40 connected to one end of the first shaft 113, and the second pulley 135 connected to the other end of the second shaft 133 may be disposed closer to the drum 30 than the first pulley 115 connected to the other end of the first shaft 113.

The second pulley 135 may be connected to the other end portion of the second shaft 133, which is opposite to one end portion of the second shaft 133 to which the drum 30 is connected. The second pulley 135 may include a second base portion 135*a* connected to the second shaft 133, a second coupling portion 135*b* coupled to the second belt 137 described later, to guide the rotation of the second belt 137, and a second extension portion 135*c* configured to connect the second base portion 135*a* to the second coupling portion 135*b*.

The second base portion 135*a* may be fixed to the other end portion of the second shaft 133, and configured to allow the second shaft 133 to rotate together with the second pulley 135 upon the rotation of the second pulley 135.

The second coupling portion 135*b* may be disposed in a circumference of the second pulley 135, and then connected to the second belt 137. As the second coupling portion 135*b* is connected to the second belt 137, the second pulley 135 may receive the rotational force of the second drive motor 131 through the second belt 137. The second pulley 135 may transmit the rotational force, which is received via the second coupling portion 135*b*, to the second shaft 133 connected to the second base portion 135*a*.

The second extension portion 135*c* may include at least one spoke along a radial direction of the second shaft 133 to connect the second base portion 135*a* to the second coupling portion 135*b*. However, although it is different from that shown in FIG. 5, the second extension portion 135*c* may include a single plate extended from the second base portion 135*a* to the second coupling portion 135*b*. The second extension portion 135*c* may transmit the rotational force, received from the second drive motor 131 by the second coupling portion 135*b*, to the second base portion 135*a*.

The second pulley 135 may receive the rotational force from the second drive motor 131 and transmit the rotational force to the drum 30. The second pulley 135 may be disposed closer to the drum 30 than the first pulley 115.

The second pulley 135 may be a pulley the same as the first pulley 115. Particularly, a diameter of the second pulley 135 may be the same as a diameter of the first pulley 115, but is not limited thereto. Alternatively, the diameter of the second pulley 135 may be different from the diameter of the first pulley 115.

The second belt 137 may connect the second drive motor 131 to the second pulley 135 to transmit the rotational force of the second drive motor 131 to the second pulley 135. Particularly, the inner surface of the second belt 137 may be brought into contact with and coupled to the second motor shaft 131*a* of the second drive motor 131 and the second coupling portion 135*b* of the second pulley 135. That is, the second belt 137 may be rotated by the second motor shaft 131*a* of the second drive motor 131 and the second coupling portion 135*b* of the second pulley 135.

The second belt 137 may be spaced apart from the first belt 117 by a predetermined distance (d). Accordingly, the second belt 137 may not be interfered with the first belt 117.

The second belt 137 may be a belt the same as the first belt 117. Particularly, a length of the second belt 137 may be the same as a length of the first belt 117, but is not limited thereto. Alternatively, the length of the second belt 137 may be different from the length of the first belt 117.

Figure 7:
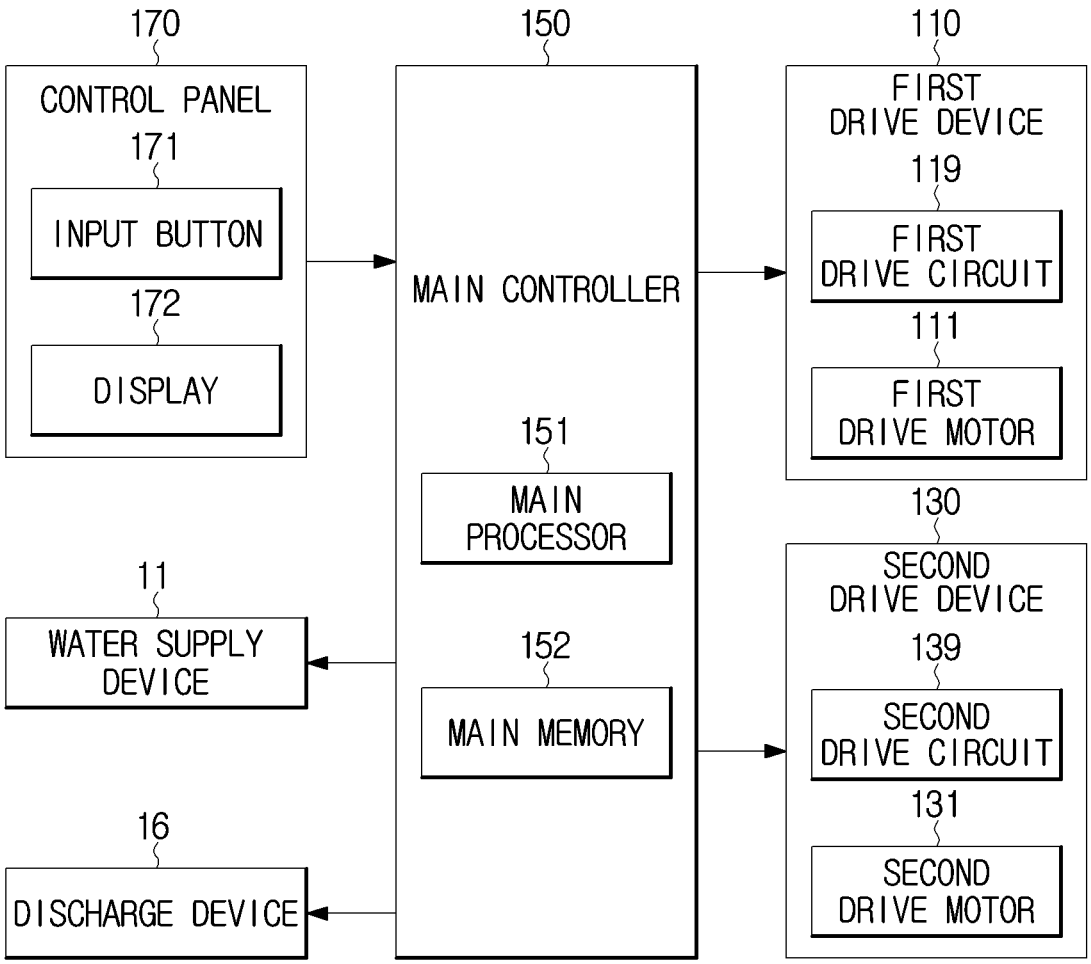
FIG. 7 is a view illustrating a configuration for controlling the operation of the washing apparatus in accordance with an embodiment.

FIG. 7 is a view illustrating a configuration for controlling the operation of the washing apparatus in accordance with an embodiment.

Referring to FIG. 7, the washing apparatus 1 may include a control panel 170, a water supply device 11, a discharge device 16, a first drive device 110, a second drive device 130 and a main controller 150.

The control panel 170 may include an input button 171 configured to receive an input related to an operation of the washing apparatus 1, and a display 172 configured to display information about the operation of the washing apparatus 1.

The input button 171 may include a plurality of buttons to receive the user's input. For example, the input button 171 may include a power button to turn on or turn off the washing apparatus 1, an operation button to start or stop the operation of the washing apparatus 1, a course button to select a washing course of the washing apparatus 1, and a detail setting button to set a detail setting such as a temperature of water, the number of rinses, and a speed of spin-dry.

The input button 171 may be implemented by various input tools such as a push switch, a touch switch, a dial, a slide switch, or a toggle switch.

Thus, the input button 171 may receive a user input, and output an electrical signal corresponding to the user input to the main controller 150.

The display 172 may include a plurality of displays to display the operation of the washing apparatus 1. For example, the display 172 may include a washing time display to display a remaining washing time during the operation of the washing apparatus 1, a course display to display the washing course of the washing apparatus 1, and a detail setting display to display a detail setting such as a temperature of water, the number of rinses, and a speed of spin-dry.

The display 172 may be implemented by various display tools such as liquid crystal display, (LCD), light emitting diodes (LED) display, organic light emitting diode (OLED) display.

Accordingly, the display 172 may receive signals regarding the operation of the washing apparatus 1 from the main controller 150, and display information according to the received signal.

The water supply device 11 may supply water into the tub 20 from an external water source and may include a water supply pipe 12 and a water supply valve 13. The configuration of the water supply device 11 may be the same as the water supply device 11 shown in FIG. 1.

The discharge device 16 may discharge the water in the tub 20 to the outside and may include a discharge pipe 17 and a drain pump 18. The construction of the discharge device 16 may be the same as the discharge device 16 shown in FIG. 1

The first drive device 110 may include a first drive motor 111 configured to rotate the pulsator 40, and a first drive circuit 119 configured to supply a first driving power to the first drive motor 111. As mentioned in FIGS. 2 to 6, the first drive device 110 may further include the first shaft 113, the first pulley 115 and the first belt 117.

The first drive motor 111 may generate a rotational force from the first driving power. The rotational force of the first drive motor 111 may be transmitted to the pulsator 40 through the first belt 117, the first pulley 115 and the first shaft 113. In other words, the first drive motor 111 may rotate the pulsator 40 in a forward direction (e.g., clockwise) or reverse direction (e.g., counterclockwise).

The first drive circuit 119 may generate the first driving power from an external power source, and provide the first driving power to the first drive motor 111 according to a control signal of the main controller 150 (e.g., a drive command or a rotational speed command).

The first drive circuit 119 may have a different topology in accordance with the type of the first drive motor 111.

For example, when the first drive motor 111 is a direct current motor, the first drive circuit 119 may convert alternating current (AC) power supplied from the external power source, into direct current (DC) power, and intermittently supply the DC power to the first drive motor 111. When the first drive motor 111 is a BLDC motor, the first drive circuit 119 may convert the AC power to the DC power, convert the DC power into square wave AC power and supply the square wave AC power to the first drive motor 111. When the first drive motor 111 is a PMSM motor, the first drive motor 111 may convert the AC power to the DC power, convert the DC power into sine wave AC power and supply the sine wave AC power to the first drive motor 111. When the first drive motor 111 is an induction motor, the first drive circuit 119 may intermittently supply AC power supplied from the external power source, to the first drive motor 111.

Further, the first drive circuit 119 may detect a first drive current, which is supplied from the first drive motor 111, to prevent the damage of the first drive motor 111 caused by the overload, and may output information about the first drive current (e.g., a first drive current value), to the main controller 150.

A configuration of the first drive circuit 119 will be described in details.

The second drive device 130 may include a second drive motor 131 configured to rotate the drum 30, and a second drive circuit 139 configured to supply a second driving power to the second drive motor 131. As mentioned in FIGS. 2 to 6, the second drive device 130 may further include the second shaft 133, the second pulley 135 and the second belt 137.

The second drive motor 131 may generate a rotational force from the second driving power. The rotational force of the second drive motor 131 may be transmitted to the drum 30 through the second belt 137, the second pulley 135 and the second shaft 133. In other words, the second drive motor 131 may rotate the drum 30 in the forward direction (e.g., clockwise) or reverse direction (e.g., counterclockwise).

The second drive circuit 139 may generate the second driving power from an external power source, and provide the second driving power to the second drive motor 131 according to a control signal of the main controller 150 (e.g., a drive command or a rotational speed command).

The second drive circuit 139 may have a different topology in accordance with the type of the second drive motor 131.

Further, the second drive circuit 139 may detect a second drive current, which is supplied from the second drive motor 131, to prevent the damage of the second drive motor 131 caused by the overload, and may output information about the second drive current (e.g., a second drive current value), to the main controller 150.

A configuration of the second drive circuit 139 will be described in details together with the first drive circuit 119.

The main controller 150 may include a main memory 152 configured to memorize/store programs and data to control the operation of the washing apparatus 1 and a main processor 151 configured to generate a control signal to control the operation of the washing apparatus 1 according to the programs and data memorized/stored in the main memory 152. The main memory 152 and the main processor 151 may be implemented as a separate chip or may be implemented in a single chip.

The main memory 152 may store a control program and control data for controlling the operation of the washing apparatus 1. For example, the main memory 152 may store data about the rotation of the drum 30 and the pulsator 40 for implementing the washing cycle (e.g., rotational speed, rotation direction, and rotation time), data about the rotation of the drum 30 and the pulsator 40 for implementing the rinsing cycle, and data about the rotation of the drum 30 and the pulsator 40 for implementing the spin-dry cycle.

In addition, the main memory 152 may store user input received via the control panel 170, and information about the operation of the washing apparatus 1 (e.g., a currently performed cycle, or a remaining operation time).

The main memory 152 may include a volatile memory such as Static Random Access Memory (S-RAM) and Dynamic Random Access Memory (D-RAM), and a non-volatile memory such as a Read Only Memory (ROM), an Erasable Programmable Read Only memory (EPROM), and an Electrically Erasable Programmable Read Only memory (EEPROM).

The main processor 151 may include an arithmetic circuit and a logic circuit. The main processor 151 may process the data according to the program provided from the main memory 152 and generate a control signal according to the result of the process.

For example, the main processor 151 may process data about the rotation of the drum 30 and the pulsator 40 stored in the main memory 152, and output a control signal to perform the washing cycle, the rinsing cycle and the spin-dry cycle (e.g., the drive command or the rotational speed command), to the first drive device 110 and the second drive device 130.

Further, the main processor 151 may receive data about the first drive current and the second drive current from the first drive device 110 and the second drive device 130. The main processor 151 may output a control signal to stop the rotation of the drum 30 and the pulsator 40 (e.g., a drive stop command), to the first drive device 110 and the second drive device 130 according to the received data.

Particularly, the operation of the washing apparatus 1 described below may be performed according to a control signal output from the main processor 151.

The main controller 150 may control the rotation of the drum 30 and the pulsator 40 so that the washing cycle, the rinsing cycle and the spin-dry cycle are performed according to the user input and the program and the data stored in the main memory 152. Particularly, the main controller 150 may output the control signal to control the rotation of the drum 30 and the pulsator 40, to the first drive device 110 and the second drive device 130, and the first drive device 110 and the second drive device 130 may rotate both of the drum 30 and the pulsator 40 according to the control signal of the main controller 150.

Hereinafter the first drive circuit 119 of the first drive device 110 and the second drive circuit 139 of the second drive device 130 configured to drive both of the drum 30 and the pulsator 40 will be described.

Figure 8:
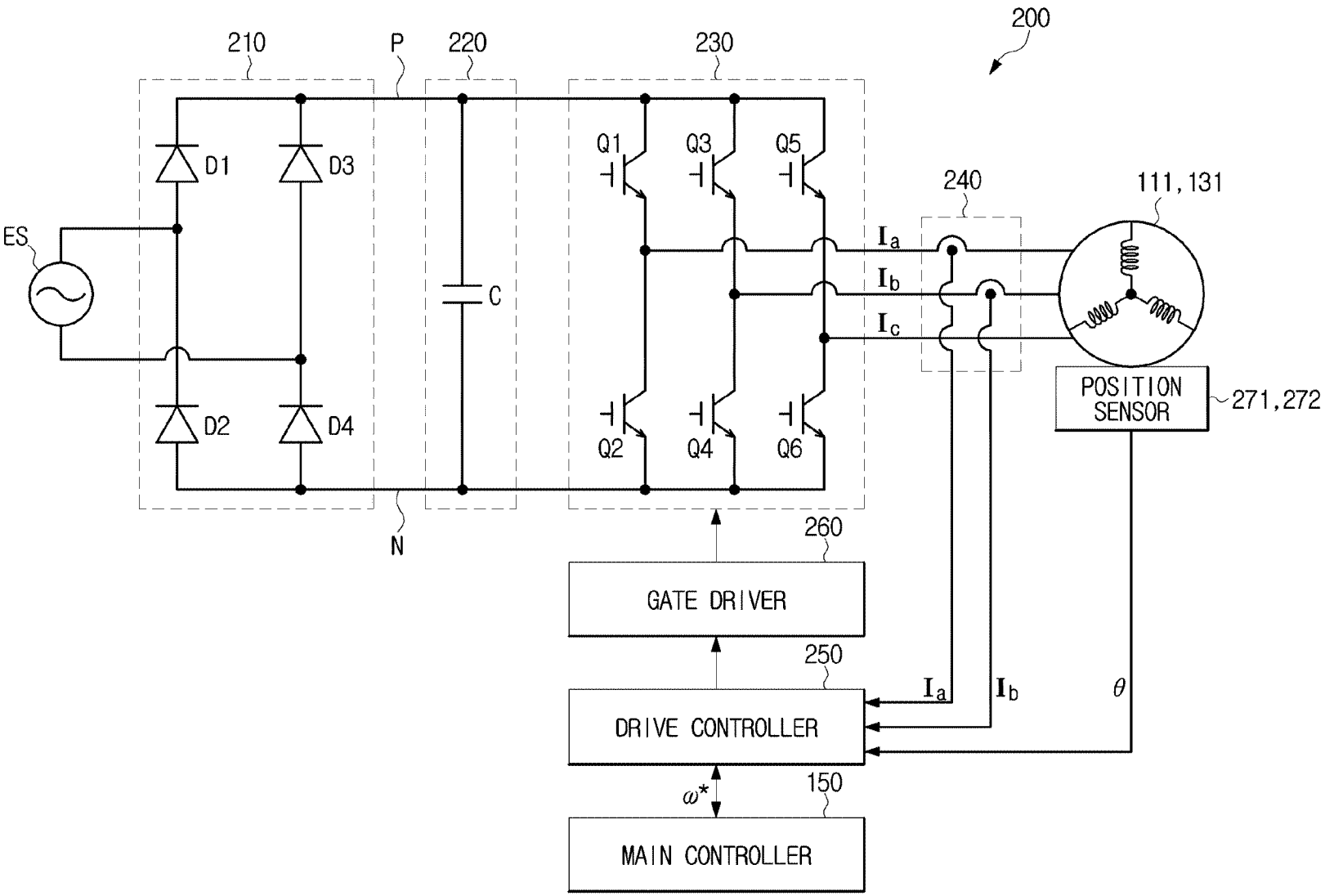
FIG. 8 is a view illustrating an example of a drive circuit contained in the washing apparatus in accordance with an embodiment.

FIG. 8 is a view illustrating an example of a drive circuit contained in the washing apparatus in accordance with an embodiment.

The first drive circuit 119 and the second drive circuit 139 may have the same configuration. The drive circuit shown in FIG. 8 may be a circuit commonly contained in the first drive circuit 119 and the second drive circuit 139.

Referring to FIG. 8, a drive circuit 200 may include a rectifier circuit 210 rectifying the AC power of the external power source (ES), a direct current (DC) link circuit 220 removing a ripple from the rectified power and outputting the DC power, an inverter circuit 230 converting the DC power into sine wave drive power and outputting the drive power to the drive motor 111 and 131, a current sensor 240 detecting the drive power (labc) supplied from the first drive motor 111 and the second drive motor 131, a drive controller 250 regulating the conversion of the first drive power of the inverter circuit 230, and a gate driver 260 turning on/off a switching circuit (Q1, Q2, Q3, Q4, Q5, and Q6) contained in the inverter circuit 230, according to a drive control signal of the drive controller 250.

Further, the drive motor 111 and 131 may be provided with a position sensor 271 and 272 measuring a position of a rotor (a rotor electrical angle) of the drive motor 111 and 131.

The rectifier circuit 210 may include a diode bridge having a plurality of diodes D1, D2, D3, and D4. The diode bridge may be provided between a positive terminal (P) and a negative terminal (N) of the drive circuit 200. The rectifier circuit 210 may rectify the AC power (AC voltage and AC current) in which the magnitude and the direction are changed according to the time, into a power having a constant direction.

The DC link circuit 220 may include a direct current (DC) link capacitor (C1) storing an electrical energy, and the DC link capacitor (C1) may be provided between the positive terminal (P) and the negative terminal (N) of the drive circuit 200. The DC link circuit 220 may be supplied with the power rectified by the rectifier circuit 210 and output the DC power having a constant magnitude and direction.

The inverter circuit 230 may include three of the switching element pairs (Q1 and Q2, Q3 and Q4, Q5 and Q6) provided between the positive terminal (P) and the negative terminal (N) of the drive circuit 200. The switching element pairs (Q1 and Q2, Q3 and Q4, Q5 and Q6) may include two switching elements (Q1 and Q2, Q3 and Q4, Q5 and Q6) that are connected in series. The switching elements (Q1, Q2, Q3, Q4, Q5 and Q6) contained in the inverter circuit 230 may be turned on/off according to the output of each gate driver 260, and three-phase drive current (labc) may be supplied to the drive motor 111 and 131 according to the turn on/off of the switching elements (Q1, Q2, Q3, Q4, Q5 and Q6).

The current sensor 240 may measure three-phase drive current (a-phase current, b-phase current, and c-phase current) output from the inverter circuit 230, and output data indicating the measured three-phase drive current (la lb, lc: labc), to the drive controller 250. In addition, the current sensor 240 may measure only two-phase current among three-phase current (labc), and the drive controller 250 may estimate any other drive current from the two-phase current.

The position sensors 271 and 272 may be provided in the drive motor 111 and 131 and measure a position of the rotor (θ) of the drive motor 111 and 131 (e.g., a rotor electrical angle), and output position data indicating the rotor electrical angle (θ). The position sensors 271 and 272 may be implemented by a hall sensor, an encoder, a resolver.

The drive controller 250 may receive the control signal (e.g., a rotational speed command) from the main controller 150, the drive current value (labc) from the current sensor 240, and the rotor position (θ) of the drive motor 111 and 131 from the position sensors 271 and 272. The drive controller 250 may calculate drive current value, which is to be supplied to the drive motor 111 and 131, based on the rotational speed command (ω*), the drive current value (Iabc), and the rotor position (θ), and output a drive control signal to control the inverter circuit 230, according to the calculated drive current value.

The gate driver 260 may output a gate signal to turn on/off the plurality of switching circuits (Q1, Q2, Q3, Q4, Q5, and Q6) contained in the inverter circuit 230, according to the drive control signal of the drive controller 250.

As described above, the drive circuit 200 may supply drive power to the drive motor 111 and 131 according to the control signal (e.g., the rotational speed command) of the main controller 150.

Figure 9:
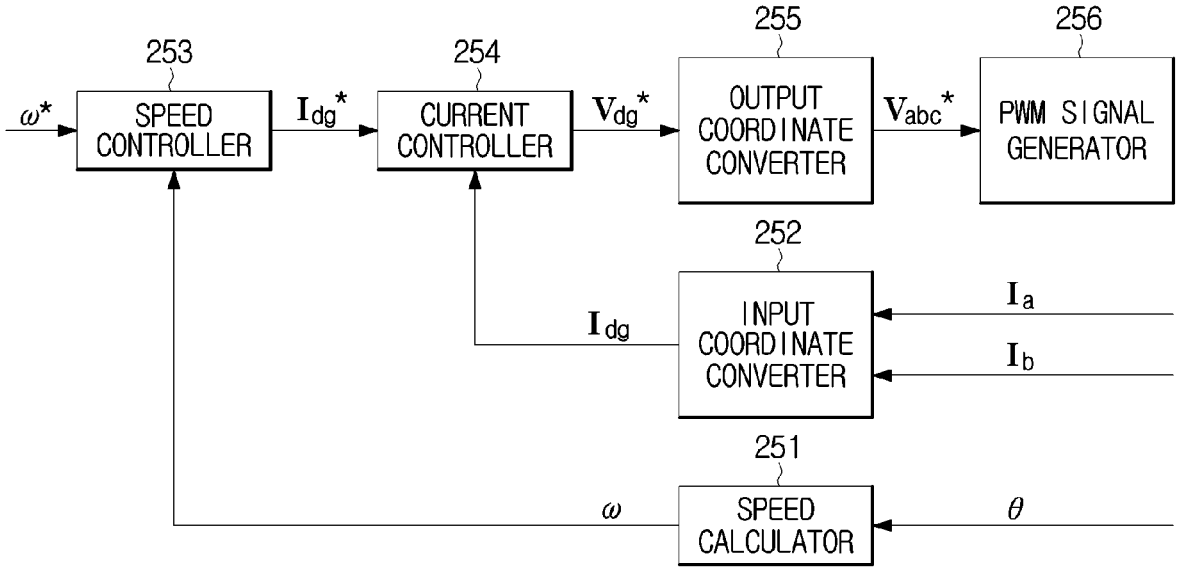
FIG. 9 is a view illustrating an example of the drive controller contained in the washing apparatus in accordance with an embodiment.

FIG. 9 is a view illustrating an example of the drive controller contained in the washing apparatus in accordance with an embodiment.

FIG. 9 illustrates an example of a drive controller to drive a PMSM motor. However, the drive controller contained in the washing apparatus 1 is not limited thereto, and thus the washing apparatus 1 may include a variety of drive controller according to the type of the drive motor 111 and 131.

Referring to FIG. 9, the drive controller 250 may include a speed calculator 251, an input coordinate converter 252, a speed controller 253, a current controller 254, an output coordinate converter 255 and a PWM signal generator 256.

The speed calculator may calculate the rotational speed value (ω) of the drive motor 111 and 131 based on the rotor electrical angle (θ) of the drive motor 111 and 131. The rotor electrical angle (θ) may be received from the position sensor 271 and 272 provided in the drive motor 111 and 131.

For example, the speed calculator 251 may calculate the rotational speed value (ω) of the drive motor 111 and 131 based on the variation of the rotor electrical angle (θ) at a sampling time interval.

Alternatively, when the position sensor 271 and 272 are not provided, the speed calculator 251 may calculate the rotational speed value (ω) of the drive motor 111 and 131 based on the drive current value (labc) measured by the current sensor 240.

According to the rotor electrical angle (θ), the input coordinate converter 252 may convert three-phase drive current value (labc) into a d-axis current value (ld) and a q-axis current value (lq) (hereinafter referred to as "dq-axis current (ldq)). In other words, the input coordinate converter 252 may perform an axis conversion from an a-axis, a b-axis, and a c-axis of the three-phase drive current value (labc), into the d-axis and the q-axis.

"d-axis" represents an axis in a direction coinciding with a direction of a magnetic field generated by the rotor of the drive motor 111 and 131, and "q-axis" represents an axis in a direction ahead by 90 degree from the direction of the magnetic field generated by the rotor of the drive motor 111 and 131. "90 degree" represents a rotor electrical angle instead of a mechanical angle of the rotor, and the electrical angle represents an angle obtained by converting an angle between N pole adjacent to the rotor or an angle between S pole adjacent to the rotor into 360 degree.

In addition, d-axis current may represent a current component generating a magnetic field in the d-axis direction among the drive current, and q-axis current may represent a current component generating a magnetic field in the q-axis direction among the drive current.

The input coordinate converter 252 may calculate a dq-axis current value (Idq) from the three-phase drive current value (Iabc) by using an equation 1.

$$\begin{bmatrix} I_d \\ I_q \end{bmatrix} = \begin{bmatrix} \cos\theta & \sin\theta \\ -\sin\theta & \cos\theta \end{bmatrix} \begin{bmatrix} 1 & 0 & 0 \\ 0 & 1/\sqrt{3} & -1/\sqrt{3} \end{bmatrix} \begin{bmatrix} I_a \\ I_b \\ I_c \end{bmatrix} \quad \text{Equation 1}$$

(Id is a d-axis current value, Iq is a q-axis current value, θ is a rotor electrical angle, Ia is a phase current value, Ib is a b-phase current value, Ic is a c-phase current value).

The speed controller 253 may compare the rotational speed command (ω*) of the main controller 150 with the rotational speed value (ω) of the drive motor 111 and 131, and output a dq axis current command (Idq*) according to a result of the comparison. Particularly, the speed controller 253 may calculate a difference between the rotational speed command (ω*) and the rotational speed value (ω) and output the dq axis current command (Idq*), which is to be supplied to the drive motor 111 and 131, by using proportional integral (PI) control.

The current controller 254 may compare a dq-axis current command (Idq*) output from the speed controller 253, with a dq-axis current value (Idq) output from the input coordinate converter 252, and output a dq-axis voltage command (Vdq*) according to a result of the comparison. Particularly, the current controller 254 may calculate a difference between the dq-axis current command (Idq*) and the dq-axis current value (Idq), and output the dq-axis voltage command (Vdq*), which is to be supplied to the drive motor 111 and 131, by using proportional integral (PI) control.

The output coordinate converter 255 may convert the dq-axis voltage command (Vdq*) into a three-phase voltage command (an a-phase voltage command, a b-phase voltage command, and a c-phase voltage command; Vabc*).

The output coordinate converter 255 may convert the dq-axis voltage command (Vdq*) into the three-phase voltage command (Vabc*) by using an equation 2.

$$\begin{bmatrix} V_a \\ V_b \\ V_c \end{bmatrix} = \begin{bmatrix} 1 & 0 \\ -1/2 & \sqrt{3}/2 \\ -1/2 & -\sqrt{3}/2 \end{bmatrix} \begin{bmatrix} \cos\theta & -\sin\theta \\ \sin\theta & \cos\theta \end{bmatrix} \begin{bmatrix} V_d \\ V_q \end{bmatrix}. \quad \text{Equation 2}$$

(Va is an a-phase voltage command, Vb is a b-phase voltage command, Vc is a c-phase voltage command, θ is a rotor electrical angle, Vd is a d-axis voltage command, and Vq is a q-axis voltage command).

The PWM signal generator 256 may generate a PWM control signal (Vpwm) to turn on or off the switching circuit (Q1, Q2, Q3, Q4, Q5, and Q6) of the inverter circuit 230, from the three-phase voltage command (Vabc*). Particularly, the PWM signal generator 256 may perform a pulse width modulation (PWM) on three-phase voltage command (Vabc*), and output a pulse width modulated control signal (Vpwm) to the gate driver 260.

The gate driver 260 may receive the PWM control signal (Vpwm), and turn on or off the switching circuit (Q1, Q2, Q3, Q4, Q5, and Q6) contained in the inverter circuit 230, according to the PWM control signal (Vpwm).

Hereinafter an operation of the washing apparatus 1 will be described according to an embodiment.

Figure 10:
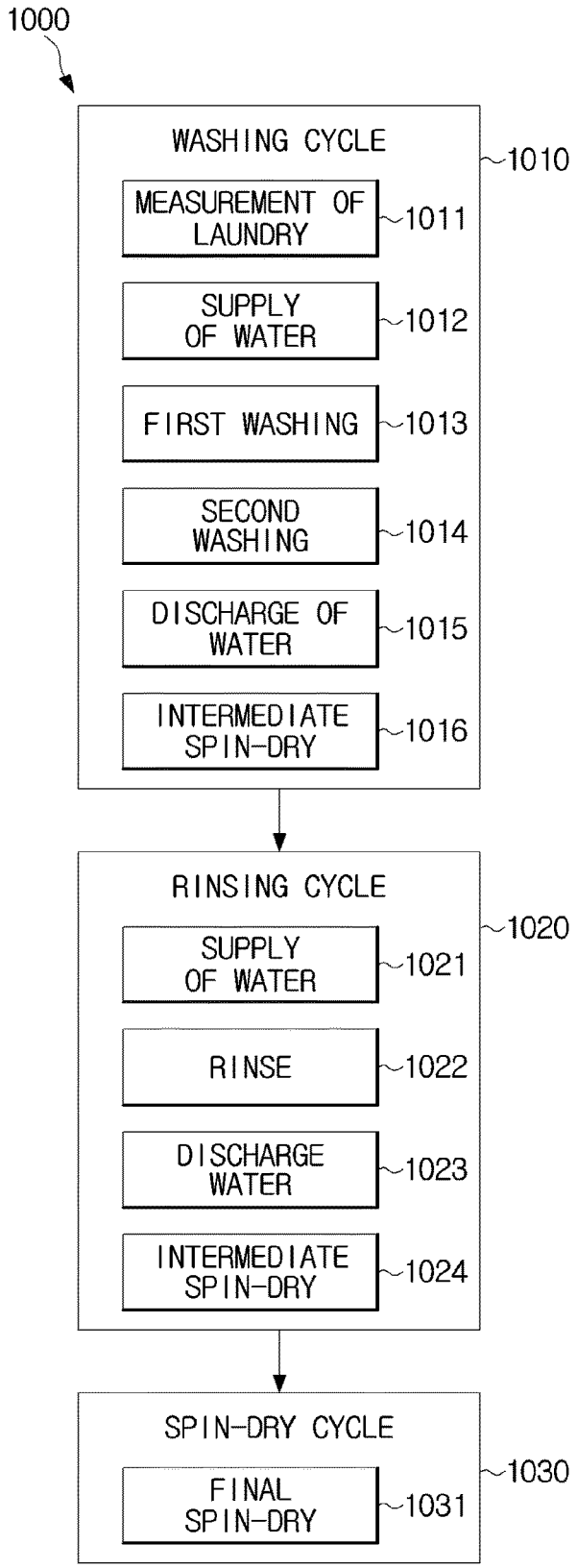
FIG. 10 is a view illustrating an example of the operation of the washing apparatus according to an embodiment.

FIG. 10 is a view illustrating an example of the operation of the washing apparatus according to an embodiment.

The washing apparatus 1 may perform sequentially a washing cycle (operation 1010), a rinsing cycle (operation 1020), and a spin-dry cycle (operation 1030).

Through the washing cycle (operation 1010), laundry may be washed. Particularly, by the chemical action of the detergent and/or the mechanical action such as dropping, foreign material adhered to the laundry may be separated.

The washing cycle (operation 1010) may include measuring laundry to measure an amount of laundry (operation 1011), supplying water to the tub 20 (operation 1012), performing a first washing to wash the laundry by driving both of the drum 30 and the pulsator 40 (operation 1013), performing a second washing to wash the laundry by driving the drum 30 (operation 1014), discharging water stored in the tub 20 (operation 1015), and performing an intermediate spin-dry to separate water from the laundry by driving the drum 30 (operation 1016).

For the measurement of the laundry (operation 1011), the main controller 150 may control the second drive device 130 so that the drum 30 is rotated in the forward or reverse direction, and measure the second drive current value supplied to the second drive motor 131. As the amount of the laundry is increased, the load of the second drive motor 131 may be increased and thus the second drive current supplied to the second drive motor 131 may be increased. Therefore, the main controller 150 may estimate the amount of the laundry based on the second drive current value.

For the supply of water (operation 1012), the main controller 150 may control the water supply device 11 so that water is supplied to the tub 20. The detergent together with the water may be supplied to the tub 20 during the supply of water (operation 1012). In addition, during the supply of water (operation 1012), the main controller 150 may measure the amount of the laundry, again. Prior to the supply of water (operation 1012), the main controller 150 may measure an amount of laundry that is not wet, i.e., dry laundry, and during the supply of water (operation 1012), the main controller 150 may measure an amount of laundry that is wet, i.e., wet laundry.

For the first washing (operation 1013), the main controller 150 may control the first drive device 110 and the second drive device 130 so that the first drive device 110 and the second drive device 130 rotate both of the drum 30 and the pulsator 40 in the forward or reverse direction.

Particularly, the main controller 150 may control the first drive device 110 and the second drive device 130 so that the drum 30 and the pulsator 40 are rotated in opposite directions to each other. In addition, the main controller 150 may control the first drive device 110 and the second drive device 130 so that the drum 30 and the pulsator 40 are alternately rotated in the forward or reverse direction. For example, for a first period, the main controller 150 may control the first drive device 110 so that the pulsator 40 is rotated in the forward direction, and the main controller 150 may control the second drive device 130 so that the drum 30 is rotated in the reverse direction. For a second period, the main controller 150 may control the first drive device 110 so that the pulsator 40 is rotated in the reverse direction, and the main controller 150 may control the second drive device 130 so that the drum 30 is rotated in the forward direction.

By the rotation of the drum 30, the laundry may be dropped from the upper side to the lower side of the drum 30 and then the laundry may be washed by the drop. In addition, by the rotation of the pulsator 40, the friction may be generated between the laundry, and the laundry may be washed by the friction. In other words, by the rotation of the drum 30 and the pulsator 40, the washing performance of the washing apparatus 1 may be improved and then the washing time may be reduced.

For the second washing (operation 1014), the main controller 150 may control the second drive device 130 so that the drum 30 is rotated in the forward or reverse direction.

Particularly, the main controller 150 may control the second drive device 130 so that the drum 30 is alternately rotated in the forward or reverse direction. In addition, the main controller 150 may control the first drive device 110 so that the first drive device 110 is not driven, i.e., the first drive circuit 119 does not output the first drive current. However, the pulsator 40 may be rotated in the same direction as the drum 30, due to the rotation of the drum 30. In other words, by the friction between the drum 30 and the laundry, and the friction between the pulsator 40 and the laundry, the pulsator 40 may be rotated together with the drum 30.

By the rotation of the drum 30, the laundry may be rolled or dropped inside of the drum 30 and thus the laundry may be washed.

For the discharge of water (operation 1015), the main controller 150 may control the discharge device 16 so that the discharge device 16 discharges the water stored in the tub 20.

For the intermediate spin-dry (operation 1016), the main controller 150 may control the second drive device 130 so that the drum 30 is rotated at a high speed. In addition, the rotational speed of the drum 30 may be increased step by step. By the high speed rotation of the drum 30, the water may be removed from the laundry stored in the drum 30 and then the water may be discharged to the outside of the washing apparatus 1.

By the rinsing cycle (operation 1020), the laundry may be washed. Particularly, the detergent or the foreign material left in the laundry may be washed out by the water.

The rinsing cycle (operation 1020) may include supplying water to the tub 20 (operation 1021), rinsing the laundry by driving the drum 30 (operation 1022), discharging the water stored in the tub 20 (operation 1023), and performing an intermediate spin-dry to remove the water from the laundry by driving the drum 30 (operation 1024).

The supply of water (operation 1021), the discharge of water (operation 1023), and the intermediate spin-dry (operation 1024) of the rinsing cycle (operation 1020) may be the same as the supply of water (operation 1012), the discharge of water (operation 1015), and the intermediate spin-dry (operation 1016) of the washing cycle (operation 1010).

For the rinsing (operation 1022), the main controller 150 may control the second drive device 130 so that the drum 30 is rotated in the forward or reverse direction. Particularly, the main controller 150 may control the second drive device 130 so that the drum 30 is alternately rotated in the forward or reverse direction. In addition, the main controller 150 may control the first drive device 110 so that the first drive motor 111 is not driven, i.e., the first drive circuit 119 does not output the first drive current.

By the rotation of the drum 30, the laundry may be rolled or dropped inside of the drum 30 and thus the laundry may be rinsed.

During the washing cycle (operation 1010), the supply of water (operation 1012), the first washing (operation 1013), the second washing (operation 1014), the discharge of water (operation 1015), and the intermediate spin-dry (operation 1016) may be performed once. Meanwhile, during the rinsing cycle (operation 1020), the supply of water (operation 1021), the rinsing (operation 1022), the discharge of water (operation 1023), and the intermediate spin-dry (operation 1024) may be performed once or by a plurality of times.

By the spin-dry cycle (operation 1030), the water in the laundry may be removed. Particularly, by the high speed rotation of the drum 30, water may be removed from the laundry and the removed water may be discharged to the outside of the washing apparatus 1.

The spin-dry cycle (operation 1030) may include a final spin-dry (operation 1031) to remove water from the laundry by rotating the drum 30 at a high speed. By the final spin-dry (operation 1031), the intermediate spin-dry (operation 1024), which is a last step of the rinsing cycle, may be omitted.

For the final spin-dry (operation 1031), the main controller 150 may control the second drive device 130 so that the drum 30 is rotated at a high speed. In addition, the rotational speed of the drum 30 may be increased step by step. By the high speed rotation of the drum 30, the water may be removed from the laundry stored in the drum 30 and then the water may be discharged to the outside of the washing apparatus 1.

By the final spin-dry (operation 1031), the operation of the washing apparatus 1 may be completed, and thus an operation time of the final spin-dry (operation 1031) may be longer than an operation of the intermediate spin-dry (operation 1016 and operation 1024).

As described above, the washing apparatus 1 may perform the washing cycle (operation 1010), the rinsing cycle (operation 1020) and the spin-dry cycle (operation 1030) to wash laundry. Particularly, the washing cycle (operation 1010) may include the first washing (operation 1013) configured to drive both of the drum 30 and the pulsator 40, and the second washing (operation 1014) configured to drive the drum 30 between the drum 30 and the pulsator 40.

Hereinafter a detail description of the first washing (operation 1013) will be described.

Figure 11:
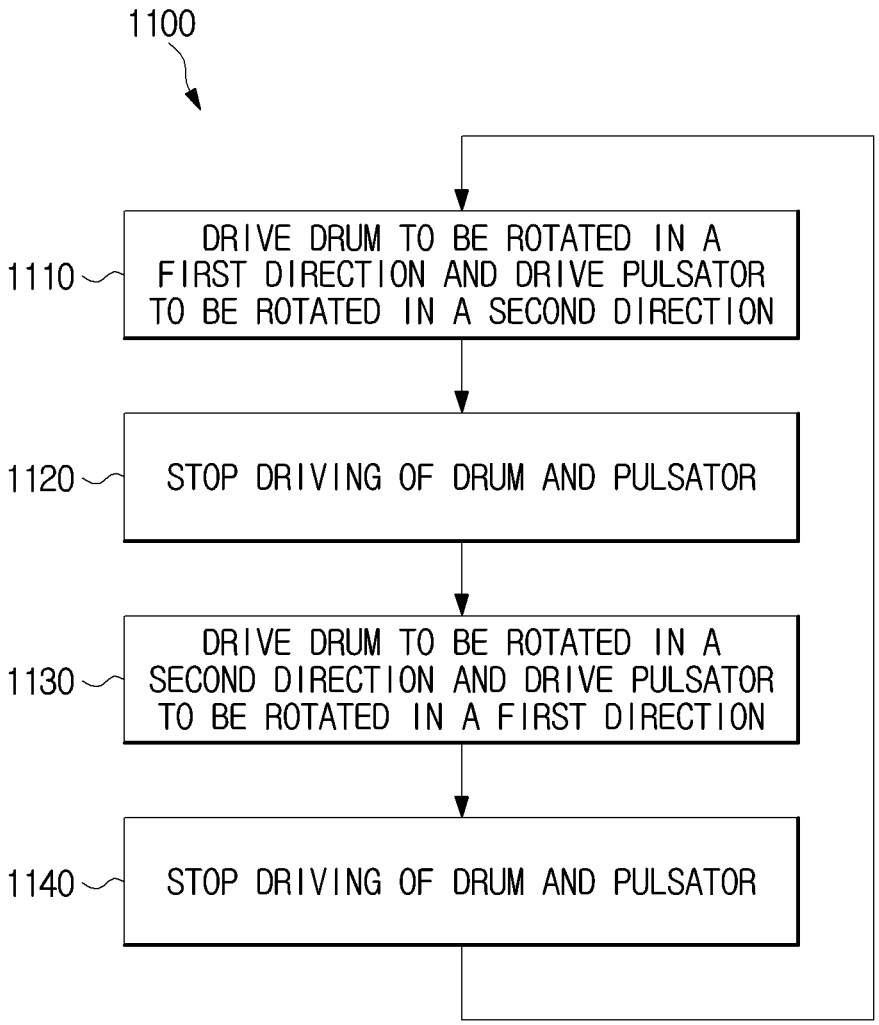
FIG. 11 is a view illustrating a first washing operation of the washing apparatus in accordance with an embodiment.
Figure 12:
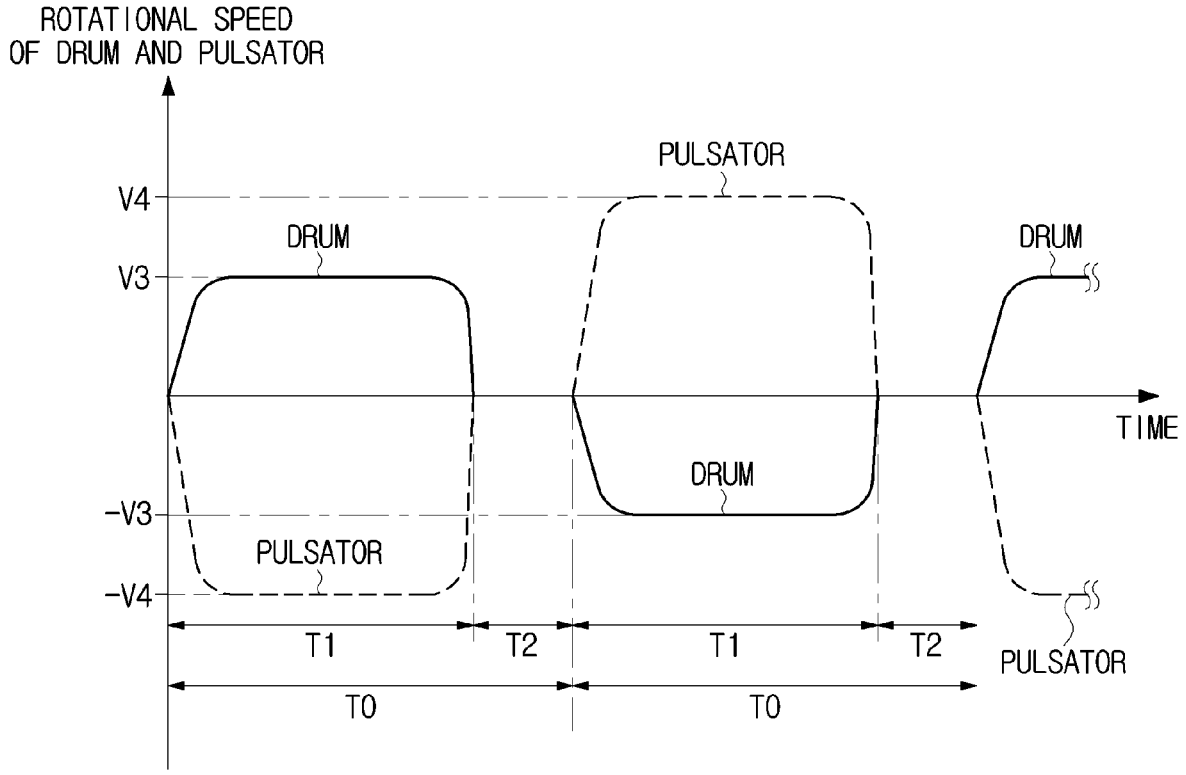
FIG. 12 is a view illustrating the rotation of the drum and the pulsator by the washing operation shown in FIG. 11.

FIG. 11 is a view illustrating a first washing operation of the washing apparatus in accordance with an embodiment. FIG. 12 is a view illustrating the rotation of the drum and the pulsator by the washing operation shown in FIG. 11.

A first washing operation (operation 1100) of the washing apparatus 1 will be described with reference to FIGS. 11 and 12.

The washing apparatus 1 may drive the drum 30 to be rotated in a first rotational direction and drive the pulsator 40 to be rotated in a second rotational direction (operation 1110).

The main controller 150 may control the second drive device 130 so that the second drive device 130 rotates the drum 30 in the first rotational direction for a first period of time (T1), and at the same time, the main controller 150 may control the first drive device 110 so that the first drive device 110 rotates the pulsator 40 is in the second rotational direction for the first period of time (T1).

For example, the main controller 150 may output a rotational speed command indicating the first rotational direction and the first rotational speed, to the second drive circuit 139. The second drive circuit 139 may supply the second drive current to the second drive motor 131 so that the second drive motor 131 is rotated in the first rotational direction at the first rotational speed. The rotational force of the second drive motor 131 may be transmitted to the second shaft 133 through the second belt 137 and the second pulley 135 as being reduced. As a result, as illustrated in FIG. 12, the drum 30 may be rotated in the first rotational direction at a third rotational speed (V3) for the first period of time (T1).

The main controller 150 may output a rotational speed command indicating the second rotational direction and the second rotational speed, to the first drive circuit 119. The first drive circuit 119 may supply the first drive current to the first drive motor 111 so that the first drive motor 111 is rotated in the second rotational direction at the second rotational speed. The rotational force of the first drive motor 111 may be transmitted to the first shaft 113 through the first belt 117 and the first pulley 115, as being reduced. As a result, the pulsator 40 may be rotated in the second rotational direction at a fourth rotational speed (V4) for the first period of time (T1).

FIG. 12 illustrates that the fourth rotational speed (V4) of the pulsator 40 is greater than the third rotational speed (V3) of the drum 30, but is not limited thereto. Alternatively, the fourth rotational speed (V4) of the pulsator 40 may be equal to or less than the third rotational speed (V3) of the drum 30.

The main controller 150 may record a driving time of the drum 30 and the pulsator 40 during the drum 30 and the pulsator 40 are driven, and when the driving time of the drum 30 and the pulsator 40 is longer than the first period of time (T1), the main controller 150 may stop the drive of the drum 30 and the pulsator 40.

As mentioned above, during the first washing (operation 1013), the washing apparatus 1 may drive the drum 30 and the pulsator 40 to be rotated in opposite directions to each other. By the rotation of the drum 30, the laundry may be dropped from the upper side to the lower side of the drum 30, and by the rotation of the drum 30, the friction between the laundry may be increased. In other words, the drop of the laundry and the friction of the laundry may improve the washing of the laundry. Therefore, the washing performance of the washing apparatus 1 may be improved and the washing time may be reduced.

The washing apparatus 1 may stop the drive of the drum 30 and the pulsator 40 (operation 1120).

The main controller 150 may control the second drive device 130 and the first drive device 110 so that the drive of the drum 30 and the pulsator 40 are stopped for the second period of time (T2).

For example, the main controller 150 may output a rotational speed command indicating "0" (zero), to the second drive circuit 139 and the first drive circuit 119, and the second drive circuit 139 and the first drive circuit 119 each may not supply the drive current to the second drive motor 131 and the first drive motor 111. As a result, the rotation of the drum 30 and the pulsator 40 may be stopped for the second period of time (T2).

The main controller 150 may record a period of time in which the drive of the drum 30 and the pulsator 40 are stopped (hereinafter referred to a stop driving time), and when the stop driving time is longer than the second period of time (T2), the main controller 150 may start the drive of the drum 30 and the pulsator 40.

The washing apparatus 1 may drive the drum 30 to be rotated in the second rotational direction and the washing apparatus 1 may drive the pulsator 40 to be rotated in the first rotational direction (operation 1130).

The main controller 150 may control the second drive device 130 so that the second drive device 130 rotates the drum 30 is in the second rotational direction for the first period of time (T1), and at the same time, the main controller 150 may control the first drive device 110 so that the first drive device 110 rotates the pulsator 40 in the first rotational direction for the first period of time (T1). As a result, as illustrated in FIG. 12, the drum 30 may be rotated in the second rotational direction at the third rotational speed (V3) for the first period of time (T1), and the pulsator 40 may be rotated in the first rotational direction at the fourth rotational speed (V4) for the first period of time (T1).

The main controller 150 may record a driving time in which both of the drum 30 and the pulsator 40 are driven, and when the driving time of the drum 30 and the pulsator 40 is longer than the first period of time (T1), the main controller 150 may stop the drive of the drum 30 and the pulsator 40.

The washing apparatus 1 may stop the drive of the drum 30 and the pulsator 40 (operation 1140).

The main controller 150 may control the second drive device 130 and the first drive device 110 so that the drive of the drum 30 and the pulsator 40 are stopped for the second period of time (T2). As a result, the rotation of the drum 30 and the pulsator 40 may be stopped for the second period of time (T2).

The washing apparatus 1 may drive the drum 30 to be rotated in the first rotational direction and drive the pulsator 40 to be rotated in the second rotational direction.

As mentioned above, during the first washing (operation 1013), the washing apparatus 1 may control the second drive device 130 so that the drum 30 is repeatedly rotated in the first rotation direction and the second rotational direction, and the washing apparatus 1 may control the first drive device 110 so that the pulsator 40 is repeatedly rotated in the first rotation direction and the second rotational direction. In addition, the sum of the first period of time (T1) in which the drum 30 and the pulsator 40 are driven and the second period of time (T2) in which the drum 30 and the pulsator 40 are not driven, may be the same as an operation period (T0) in which the drum 30 and the pulsator 40 repeatedly performs the rotation.

By the rotation of the drum 30, the laundry may be dropped from the upper side to the lower side of the drum 30, and the laundry may be washed by the drop. In addition, since the pulsator 40 is rotated in a direction different from a direction of the drum 30, the friction may be generated between laundry and thus the laundry may be washed by the friction.

As mentioned above, since the drum 30 and the pulsator 40 are provided and the drum 30 and the pulsator 40 are rotated in different directions from each other, the drop of the laundry and the friction between the laundry may affect the washing of the laundry and thus the washing performance of the washing apparatus 1 may be improved and the washing time may be reduced.

Figure 13:
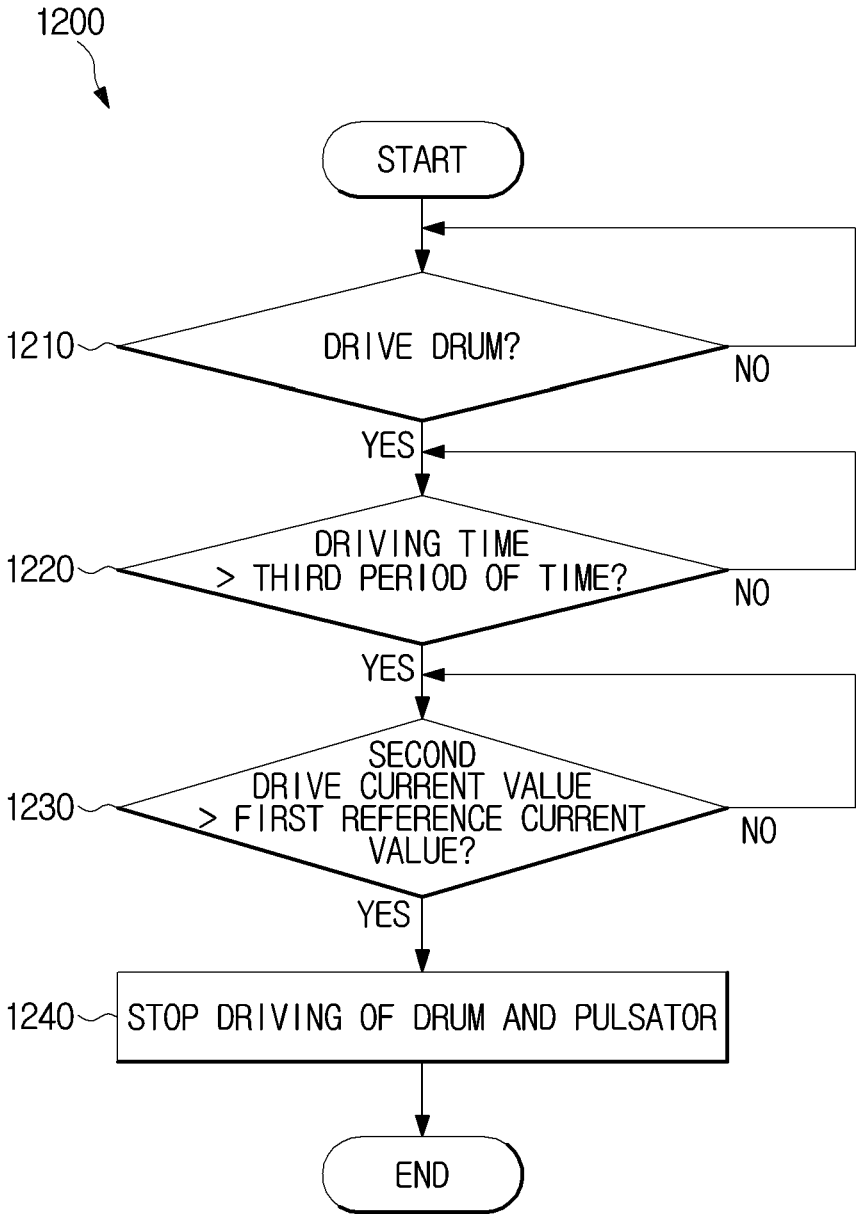
FIG. 13 is a view illustrating an operation of the second drive motor by the first washing operation of the washing apparatus in accordance with an embodiment.
Figure 14:
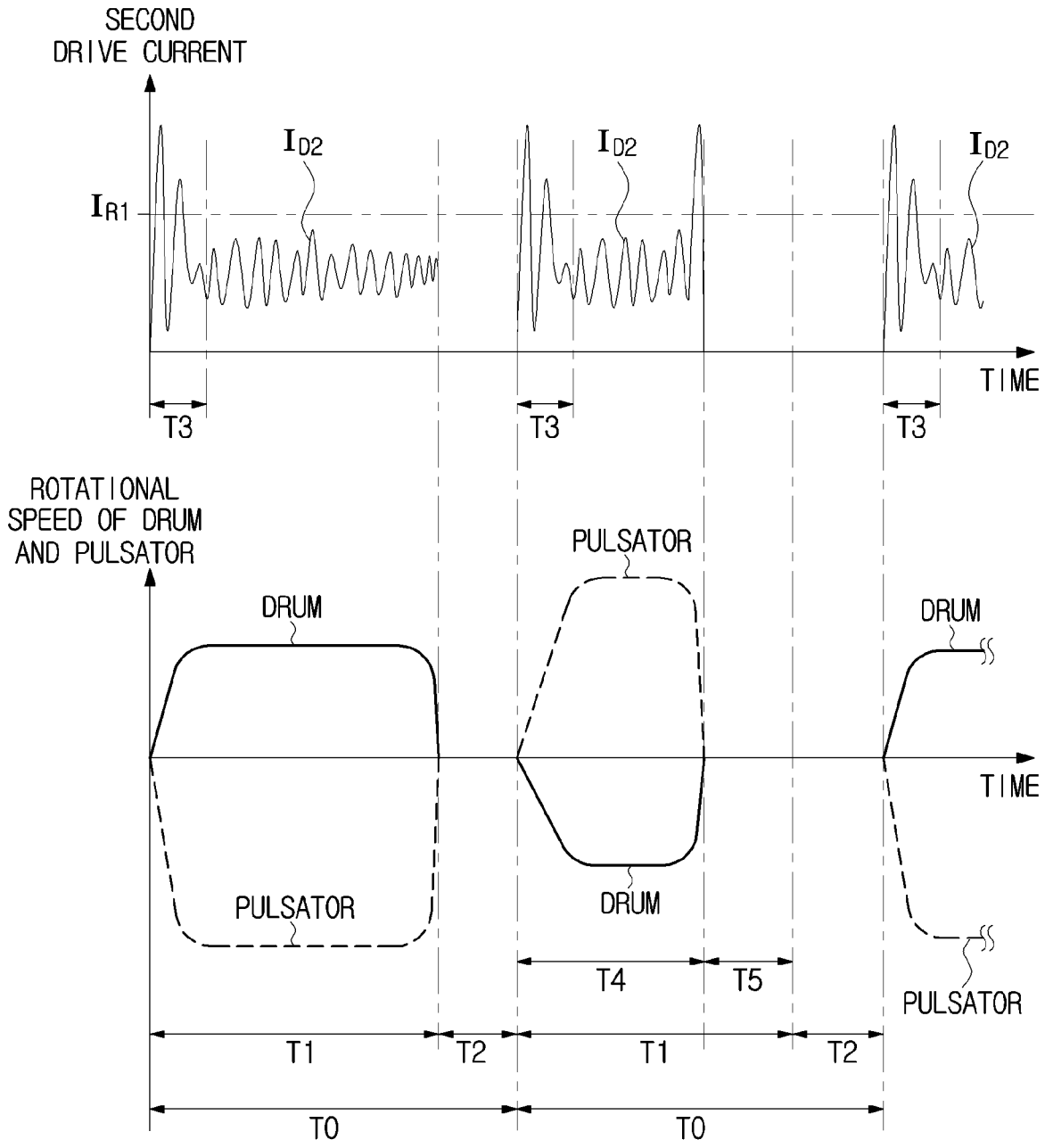
FIG. 14 is a view illustrating a rotation of the drum and the pulsator by the operation of the second drive motor shown in FIG. 13.

FIG. 13 is a view illustrating an operation of the second drive motor by the first washing operation of the washing apparatus in accordance with an embodiment. FIG. 14 is a view illustrating a rotation of the drum and the pulsator by the operation of the second drive motor shown in FIG. 13.

As mentioned above, since the drum 30 and the pulsator 40 are rotated in different directions from each other during the first washing (operation 1013), the laundry may be twisted or entangled with each other. In addition, since the drum 30, and the pulsator 40 installed in the rear surface of the drum 30 are rotated in different directions from each other, the laundry may be moved to the front side in the inside of the drum 30. In other words, by the friction between the laundry and the pulsator 40, the laundry may be moved to the front side of the drum 30.

Accordingly, since the laundry twisted with each other in the drum 30 is moved to the front side of the drum 30, the laundry may be stuck between the door 60 and the drum 30 and then the laundry stuck between the door 60 and the drum 30 may prevent the rotation of the drum 30.

The load of the second drive motor 131 configured to rotate the drum 30 may be increased by the laundry stuck between the door 60 and the drum 30. As a result, the second drive current supplied to the second drive motor 131 may be increased and thus the second drive motor 131 may be overheated.

The washing apparatus 1 may perform an overheat prevention operation (operation 1200) of the second drive motor 131 to prevent the overheating of the second drive motor 131. In addition, the washing apparatus 1 may repeatedly perform the overheat prevention operation (operation 1200) at a predetermined time interval.

The washing apparatus 1 may determine whether the drum 30 is driven to be rotated (operation 1210).

As mentioned above, the washing apparatus 1 may rotate the drum 30 for the first period of time (T1) and stop the drive of the drum 30 for the second period of time (T2). Particularly, the main controller 150 may output a control signal to the second drive device 130 so that the second drive device 130 drives the drum 30 for the first period of time (T1), and the main controller 150 may output a control signal to the second drive device 130 so that the second drive device 130 stops the drive of the drum 30 for the second period of time (T2).

The main controller 150 may determine whether the second drive device 130 is driven to rotate the drum 30 according to the control signal output to the second drive device 130.

When the drum 30 is not driven (No in 1210), the washing apparatus 1 may repeatedly determine whether the drum 30 is driven.

When the drum 30 is driven (Yes in 1210), the washing apparatus 1 may determine whether the driving time of the drum 30 is longer than the third period of time (T3) (operation 1220).

As mentioned above, the washing apparatus 1 may record the driving time of the drum 30 during the drum 30 is driven. Particularly, after the main controller 150 outputs a control signal to the second drive device 130 so as to drive of the drum 30, the main controller 150 may record a point of time in which the control signal is output.

The main controller 150 may compare the driving time of the drum 30 with the third period of time (T3), and determine whether the driving time of the drum 30 is longer than the third period of time (T3).

The third period of time (T3; e.g. an approximately three seconds) may represent a period of time until the rotation of the drum 30 becomes stable. When a large load is applied to the second drive motor 131 to rotate the stopped drum 30, the second drive current having a large value may be supplied to the second drive motor 131. The second drive current that is unstable may be supplied to the second drive motor 131 for a short period of time after the rotation of the drum 30 is started.

For example, as illustrated in FIG. 14, the second drive current value ($I_{D2}$) may be greatly increased within the third period of time (T3) after the rotation of the drum 30 is started. The increase of the second drive current may be caused by the increase of the load due to the start of the rotation of the drum 30, not by the overload of the second drive motor 131.

Therefore, in order to precisely prevent the overheating, the main controller 150 may not monitor the second drive current supplied to the second drive motor 131, for approximately third period of time (T3) after the drum 30 is driven.

When the driving time of the drum 30 is not greater than the third period of time (T3) (No in 1220), the washing apparatus 1 may continuously compare the driving time of the drum 30 with the third period of time (T3).

As mentioned above, in order to precisely prevent the overheating, the main controller 150 may not monitor the second drive current supplied to the second drive motor 131, for approximately third period of time (T3) after the drum 30 is driven.

For example, as illustrated in FIG. 14, although the second drive current value ($I_{D2}$) is greatly increased within the third period of time (T3) after the drum 30 is driven, the washing apparatus 1 may maintain the drive of the drum 30.

When the driving time of the drum 30 is greater than the third period of time (T3) (Yes in 1220), the washing apparatus 1 may determine whether the second drive current value ($I_{D2}$) is greater than the first reference current value ($I_{R1}$) (operation 1230).

As mentioned above, the magnitude of the second drive current (current value) may be increased by the increase in the load of the second drive motor 131. In addition, when the second drive current value ($I_{D2}$) is greater than the predetermined first reference current value ($I_{R1}$), the washing apparatus 1 may determine whether the second drive motor 131 is overloaded.

Therefore, in order to determine the overload of the second drive motor 131, the main controller 150 may compare the second drive current value ($I_{D2}$) with the first reference current value ($I_{R1}$), and determine whether the second drive current value ($I_{D2}$) is greater than the first drive current value ($I_{R1}$).

The second drive current value ($I_{D2}$) may represent a current value output by the second drive circuit 139 to the second drive motor 131. For example, the second drive current value ($I_{D2}$) may represent the three-phase drive current value (Iabc) as illustrated in FIGS. 8 and 9.

However, the second drive current value ($I_{D2}$) is not limited to a current value output by the second drive circuit 139 to the second drive motor 131. For example, the second drive current value ($I_{D2}$) may represent the dq-axis current value (Idq), the d-axis current value (Id), and/or the q-axis current value (Iq) as illustrated in FIGS. 8 and 9.

When the second drive current value ($I_{D2}$) is not greater than the first reference current value ($I_{R1}$) (No in 1230), the washing apparatus 1 may repeatedly compare the second drive current value ($I_{D2}$) with the first reference current value ($I_{R1}$).

When the second drive current value ($I_{D2}$) is not greater than the first reference current value ($I_{R1}$), the washing apparatus 1 may determine that the second drive motor 131 may be operated normally. Therefore, the washing apparatus 1 may maintain the drive of the drum 30. For example, as illustrated in FIG. 14, when the second drive current value ($I_{D2}$) is less than the first reference current value ($I_{R1}$), the washing apparatus 1 may maintain the drive of the drum 30 for the first period of time (T1).

When the second drive current value ($I_{D2}$) is greater than the first reference current value ($I_{R1}$) (Yes in 1230), the washing apparatus 1 may stop the drive of both of the drum 30 and the pulsator 40 (operation 1240).

When the second drive current value ($I_{D2}$) is greater than the first reference current value ($I_{R1}$), the washing apparatus 1 may determine that the second drive motor 131 is overloaded. Therefore, the washing apparatus 1 may stop the drive of the second drive motor 131 to prevent the overheating of the second drive motor 131.

In addition, the overload of the second drive motor 131 configured to drive the drum 30 is caused by the twist of the laundry, and the twist of the laundry is caused by the rotation of the pulsator 40. Therefore, in order to prevent the laundry from being twisted, the washing apparatus 1 may stop the drive of the pulsator 40 together with the drive of the drum 30.

For example, as illustrated in FIG. 14, when the second drive current value ($I_{D2}$) is greater than the first reference current value ($I_{R1}$) during both of the drum 30 and the pulsator 40 are driven, the washing apparatus 1 may stop the drive of both of the drum 30 and the pulsator 40. Since the drive of both of the drum 30 and the pulsator 40 is stopped, the rotation of the drum 30 and the pulsator 40 may be stopped.

In addition, the washing apparatus 1 may stop the drive of the drum 30 and the pulsator 40 for a remaining time (T5) in the first period of time (T1) and for the second period of time (T2).

For example, as illustrated in FIG. 14, the washing apparatus 1 may stop the drive of the drum 30 and the pulsator 40 when a fourth period of time (T4) is expired from when the drive of the drum 30 and the pulsator 40 is started. In this case, the washing apparatus 1 may stop the drive of the drum 30 and the pulsator 40 for the fifth period of time (T5) corresponding to a difference between the first period of time (T1) and the fourth period of time (T4), and further stop the drive of the drum 30 and the pulsator 40 for the second period of time (T2).

Accordingly, although the drive of the drum 30 and the pulsator 40 is stopped due to the overload of the second drive motor 131, the washing apparatus 1 may re-drive the drum 30 and the pulsator 40 when the operation period (T0) is expired from when the drive of the drum 30 and the pulsator 40 is started. In other words, although the drive of the drum 30 and the pulsator 40 is stopped due to the overload of the second drive motor 131, the washing apparatus 1 may re-drive the drum 30 and the pulsator 40 by a predetermined operation period (T0).

As mentioned above, in order to prevent the overload due to the twist of the laundry, the washing apparatus 1 may stop the drive of the drum 30 and the pulsator 40 when the second drive current value ($I_{D2}$) of the second drive motor 131 is greater than the first reference current value ($I_{R1}$).

Figure 15:
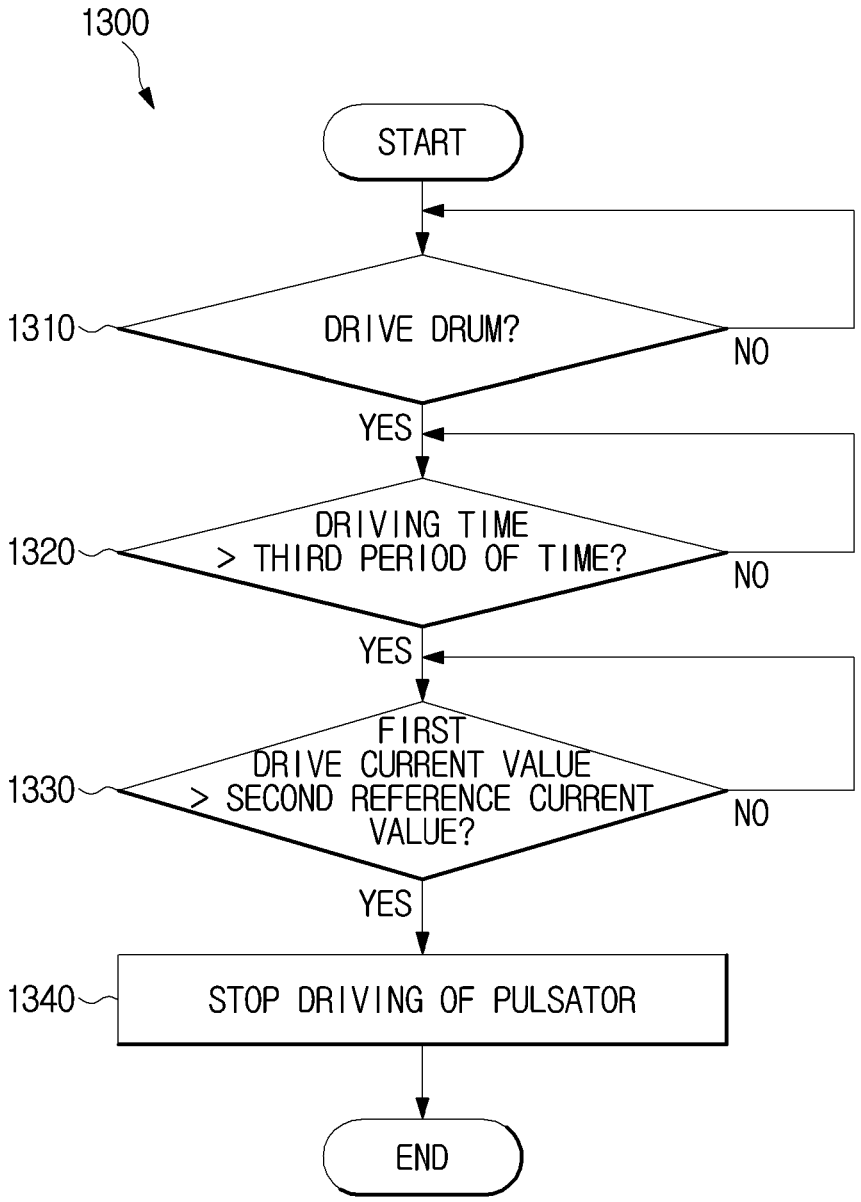
FIG. 15 is a view illustrating an operation of the first drive motor by the first washing operation of the washing apparatus in accordance with an embodiment.
Figure 16:
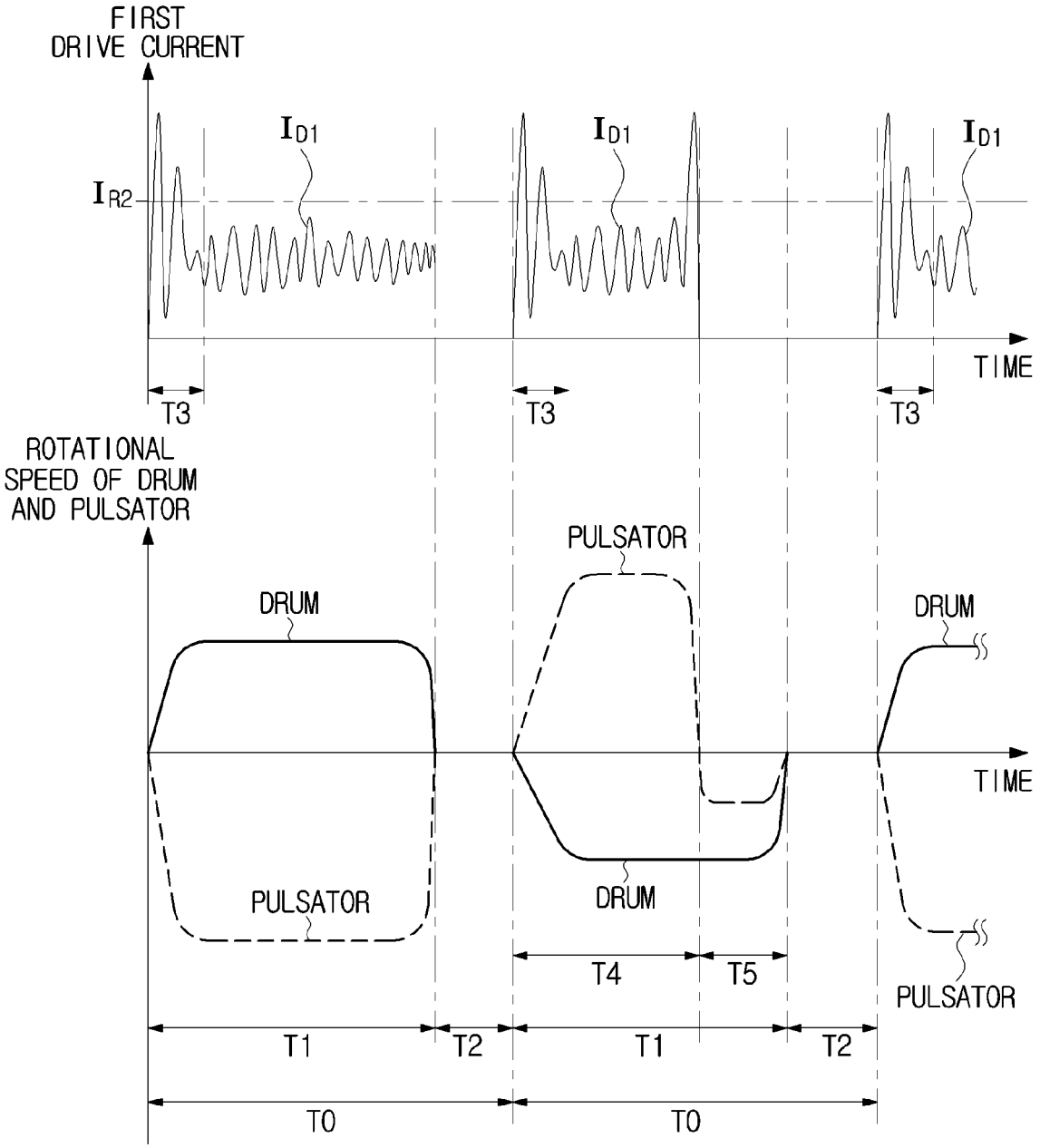
FIG. 16 is a view illustrating a rotation of the drum and the pulsator by the operation of the first drive motor shown in FIG. 15.

FIG. 15 is a view illustrating an operation of the first drive motor by the first washing operation of the washing apparatus in accordance with an embodiment. FIG. 16 is a view illustrating a rotation of the drum and the pulsator by the operation of the first drive motor shown in FIG. 15.

As mentioned above, since the drum 30 and the pulsator 40 are rotated in different directions from each other during the first washing (operation 1013), the laundry may be twisted or entangled with each other in the drum 30. The twisted or entangled laundry may be stuck in the door 60 of the washing apparatus 1, and thus the load of the second drive motor 131 configured to rotate the drum 30 may be increased. In addition, the load of the first drive motor 111 configured to rotate the pulsator 40 may be also increased and thus the overload of the first drive motor 111 may be generated.

The twisted or entangled laundry may press the pulsator 40 in a direction parallel with the rotary shaft of the pulsator 40. As a result, a non-uniform force may be applied to the first shaft 113 connected to the pulsator 40 and thus a noise may be generated by the friction between the first shaft 113 and the second shaft 133.

The washing apparatus 1 may perform an overheat/noise prevention operation (operation 1300) of the first drive motor 111 to prevent the overheating and noise of the first drive motor 111. In addition, the washing apparatus 1 may repeatedly perform the overheat/noise prevention operation (operation 1300) at a predetermined time interval.

The washing apparatus 1 may determine whether the pulsator 40 is driven to be rotated (operation 1310).

As mentioned above, the washing apparatus 1 may drive the pulsator 40 to be rotated for the first period of time (T1) and stop the drive of the pulsator 40 for the second period of time (T2). Particularly, the main controller 150 may output a control signal to the first drive device 110 so that the first drive device 110 drives the pulsator 40 for the first period of time (T1), and the main controller 150 may output a control signal to the first drive device 110 so that the first drive device 110 stops the drive of the pulsator 40 for the second period of time (T2).

The main controller 150 may determine whether the first drive device 110 is driven to rotate the pulsator 40 according to the control signal output to the first drive device 110.

When the pulsator 40 is not driven (No in 1310), the washing apparatus 1 may repeatedly determine whether the pulsator 40 is driven.

When the pulsator 40 is driven (Yes in 1310), the washing apparatus 1 may determine whether the driving time of the pulsator 40 is longer than the third period of time (T3) (operation 1320).

As mentioned above, the washing apparatus 1 may record the driving time of the pulsator 40 during the pulsator 40 is driven. Particularly, after the main controller 150 outputs a control signal to the first drive device 110 so as to drive of the pulsator 40, the main controller 150 may record a point of time in which the control signal is output.

The main controller 150 may compare the driving time of the pulsator 40 with the third period of time (T3), and determine whether the driving time of the pulsator 40 is longer than the third period of time (T3). The third period of time (T3; e.g. an approximately three seconds) may represent a period of time until the rotation of the pulsator 40 becomes stable.

Therefore, in order to precisely prevent the overheating and noise, the main controller 150 may not monitor the first drive current supplied to the first drive motor 111, for approximately third period of time (T3) after the pulsator 40 is driven.

When the driving time of the pulsator 40 is not greater than the third period of time (T3) (No in 1320), the washing apparatus 1 may continuously compare the driving time of the pulsator 40 with the third period of time (T3).

As mentioned above, in order to precisely prevent the overheating and the noise, the main controller 150 may not monitor the first drive current supplied to the first drive motor 111, for approximately third period of time (T3) after the pulsator 40 is driven.

When the driving time of the pulsator 40 is greater than the third period of time (T3) (Yes in 1320), the washing apparatus 1 may determine whether the first drive current value ($I_{D1}$) is greater than the second drive current value ($I_{R2}$) (operation 1330).

As mentioned above, the magnitude of the first drive current (current value) may be increased by the increase in the load of the first drive motor 111. In addition, when the first drive current value ($I_{D1}$) is greater than the predetermined second reference current value ($I_{R2}$), the washing apparatus 1 may determine whether the first drive motor 111 is overloaded.

Therefore, in order to determine the overload of the first drive motor 111, the main controller 150 may compare the first drive current value ($I_{D1}$) with the second reference current value ($I_{R2}$), and determine whether the first drive current value ($I_{D1}$) is greater than the second reference current value ($I_{R2}$). The second drive current value ($I_{D2}$) may represent the three-phase drive current value (labc) or the dq-axis current value (ldq), as illustrated in FIGS. 8 and 9.

When the first drive current value ($I_{D1}$) is not greater than the second reference current value ($I_{R2}$) (No in 1330), the washing apparatus 1 may repeatedly compare the first drive current value ($I_{D1}$) with the second reference current value ($I_{R2}$).

When the first drive current value ($I_{D1}$) is not greater than the second reference current value ($I_{R2}$), the washing apparatus 1 may determine that the first drive motor 111 is operated normally. Therefore, the washing apparatus 1 may maintain the drive of the pulsator 40.

When first drive current value ($I_{D1}$) is greater than the second reference current value ($I_{R2}$) (Yes in 1330), the washing apparatus 1 may stop the drive of the pulsator 40 between the drum 30 the pulsator 40 (operation 1340).

When first drive current value ($I_{D1}$) is greater than the second reference current value ($I_{R2}$), the washing apparatus 1 may determine that the first drive motor 111 is overloaded. Therefore, the washing apparatus 1 may stop the drive of the first drive motor 111 to prevent the overheating of the first drive motor 111.

However, when it is not determined that the second drive motor 131 configured to drive the drum 30 is overloaded, the washing apparatus 1 may not stop the drive of the drum 30 for the washing of the laundry. In other words, the washing apparatus 1 may stop the drive of only the pulsator 40.

For example, as illustrated in FIG. 16, when the first drive current value ($I_{D1}$) is greater than the second reference current value ($I_{R2}$) during both of the drum 30 and the pulsator 40 are driven, the washing apparatus 1 may stop the drive of only the pulsator 40 between the drum 30 and the pulsator 40.

Since the drive of only the pulsator 40 is stopped, the rotation of the drum 30 may be maintained. In addition, the laundry in the drum 30 may be rotated by the rotation of the drum 30, and the pulsator 40 may be rotated in the same direction as the drum 30 by the friction between the laundry and the pulsator 40. However, the rotation of the pulsator 40 may be caused by the rotation of the drum 30 instead of the drive of the first drive device 110.

In addition, the washing apparatus 1 may stop the drive of the pulsator 40 for a remaining time (T5) in the first period of time (T1) and for the second period of time (T2).

For example, as illustrated in FIG. 16, the washing apparatus 1 may stop the drive of only the pulsator 40 when a fourth period of time (T4) is expired from when the drive of the drum 30 and the pulsator 40 is started. In this case, the washing apparatus 1 may stop the drive of the pulsator 40 for the fifth period of time (T5) corresponding to a difference between the first period of time (T1) and the fourth period of time (T4), and further stop the drive of the pulsator 40 for the second period of time (T2). In addition, the washing apparatus 1 may drive the drum 30 for the first period of time (T1) and stop the drive of the drum 30 for the second period of time (T2).

Accordingly, although the drive of the pulsator 40 is stopped due to the overload of the first drive motor 111, the washing apparatus 1 may re-drive the pulsator 40 when the operation period (T0) is expired from when the drive of the drum 30 and the pulsator 40 is started. In addition, the washing apparatus 1 may drive the drum 30 by the operation period (T0). In other words, although the drive of the pulsator 40 is stopped, the washing apparatus 1 may simultaneously drive the drum 30 and the pulsator 40 by a predetermined operation period (T0).

As mentioned above, in order to prevent the overload and the noise due to the twist of the laundry, the washing apparatus 1 may stop the drive of only the pulsator 40 when the first drive current value ($I_{D1}$) of the first drive motor 111 is greater than the second reference current value ($I_{R2}$).

Figure 17:
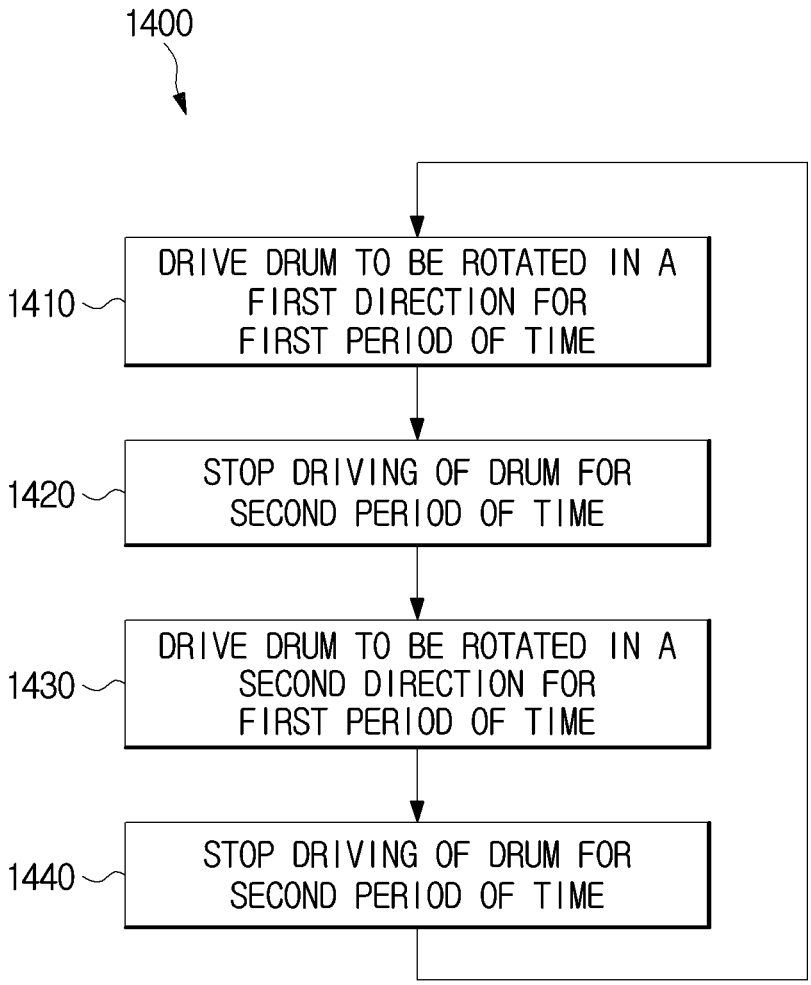
FIG. 17 is a view illustrating an example of a second washing operation and a rinsing operation of the washing apparatus in accordance with an embodiment.
Figure 18:
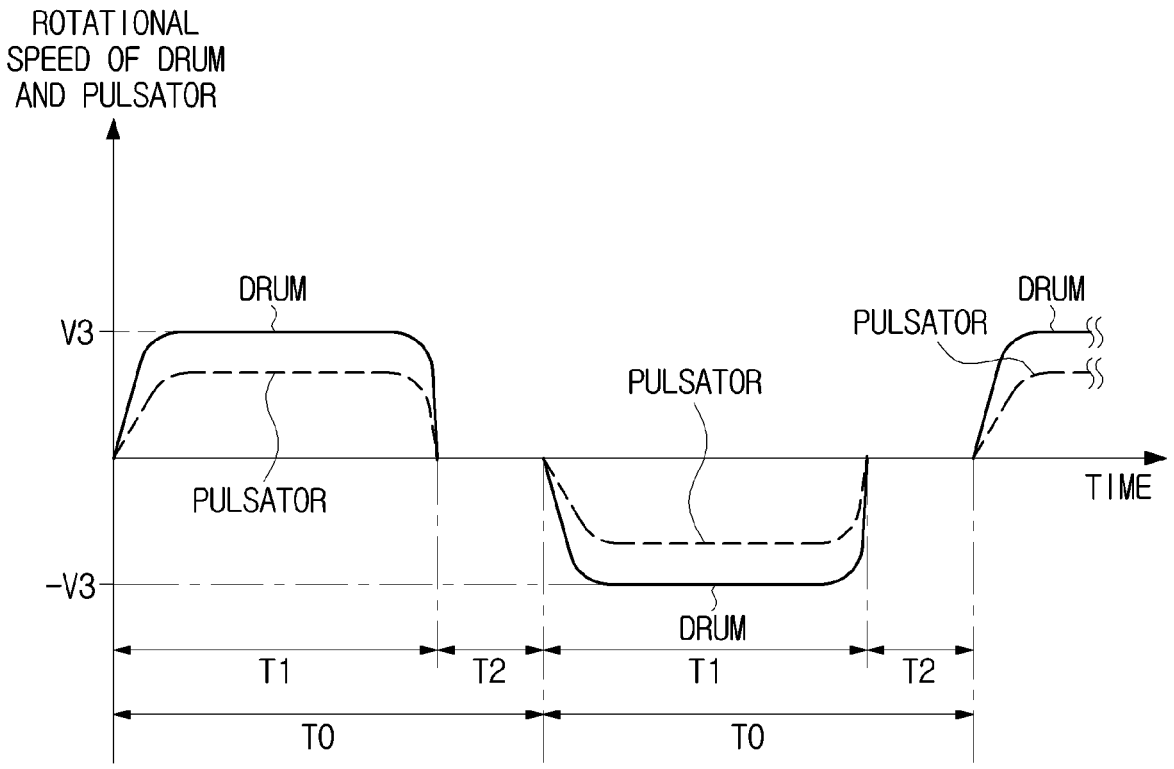
FIG. 18 is a view illustrating the rotation of the drum and the pulsator by the second washing operation and the rinsing operation shown in FIG. 17.

FIG. 17 is a view illustrating an example of a second washing operation and a rinsing operation of the washing apparatus in accordance with an embodiment. FIG. 18 is a view illustrating the rotation of the drum and the pulsator by the second washing operation and the rinsing operation shown in FIG. 17.

A second washing operation (operation 1400) of the washing apparatus 1 will be described with reference to FIGS. 17 and 18. A rinsing operation of the washing apparatus 1 may be the same as the second washing operation (operation 1400).

The washing apparatus 1 may drive the drum 30 to be rotated in a first rotational direction (operation 1410).

The main controller 150 may control the second drive device 130 so that the drum 30 is rotated in the first rotational direction for the first period of time (T1), and at the same time, the main controller 150 may control the first drive device 110 so that the pulsator 40 is not rotated.

For example, the main controller 150 may output a rotational speed command indicating the first rotational direction and the first rotational speed, to the second drive circuit 139. The second drive circuit 139 may supply the second drive current to the second drive motor 131 so that the second drive motor 131 is rotated in the first rotational direction at the first rotational speed. The rotational force of the second drive motor 131 may be transmitted to the second shaft 133 through the second belt 137 and the second pulley 135 as being reduced. As a result, as illustrated in FIG. 18, the drum 30 may be rotated in the first rotational direction at a third rotational speed (V3) for the first period of time (T1).

The main controller 150 may output a rotational speed command indicating "0" (zero), to the first drive circuit 119, and the first drive circuit 119 may not output the drive current to the first drive motor 111.

Although the first drive motor 111 does not drive the pulsator 40, the pulsator 40 may be rotated as illustrated in FIG. 18. During the first drive motor 111 does not drive the pulsator 40, the second drive motor 131 may be driven to rotate the drum 30. As a result, although the pulsator 40 is not driven, the drum 30 may be maintained to be rotated. In addition, the laundry in the drum 30 may be also rotated by the rotation of the drum 30, and by the friction between the laundry and the pulsator 40, the pulsator 40 may be rotated in the same direction as the drum 30 at a rotational speed less than the third rotational speed (V3).

The main controller 150 may record a driving time of the drum 30 during the drum 30 is driven, and when the driving time of the drum 30 is greater than the first period of time (T1), the main controller 150 may stop the drive of the drum 30.

During the first washing (operation 1013), the washing apparatus 1 may rotate the drum 30 and the pulsator 40 in different directions from each to improve the washing performance, and thus the laundry in the drum 30 may be twisted.

During the second washing (operation 1014) and/or the rinsing (operation 1022), the washing apparatus 1 may rotate the drum 30 to untwist the twisted laundry while washing the laundry. By the rotation of the drum 30, the pulsator 40 may be also rotated and untwist the twisted laundry in the drum 30.

Accordingly, by untwisting the twisted laundry during the second washing (operation 1014) and/or the rinsing (operation 1022), it may be possible to reduce the unbalance of the laundry during the intermediate spin-dry (operation 1016 and operation 1024) that is performed later.

The washing apparatus 1 may stop the drive of the drum 30 (operation 1420).

The main controller 150 may control the second drive device 130 so that the drive of the drum 30 is stopped for the second period of time (T2). The second drive device 130 may not drive the pulsator 40. For example, the second drive circuit 139 and the first drive circuit 119 may not supply the drive current to the second drive motor 131 and the first drive motor 111 according to the control of the main controller 150. As a result, the rotation of the drum 30 and the pulsator 40 may be stopped for the second period of time (T2).

The main controller 150 may record a stop driving time of the drum 30, and when the stop driving time is longer than the second period of time (T2), the main controller 150 may re-start the drive of the drum 30.

As a result, the rotation of the drum 30 and the pulsator 40 may be stopped for the second period of time (T2).

The washing apparatus 1 may drive the drum 30 to be rotated in the second rotational direction (operation 1430).

The main controller 150 may control the second drive device 130 so that the drum 30 is rotated in the second rotational direction for the first period of time (T1), and at the same time, the main controller 150 may control the first drive device 110 so that the pulsator 40 is not rotated. As a result, as illustrated in FIG. 18, the drum 30 may be rotated in the second rotational direction at the third rotational speed (V3) for the first period of time (T1).

The main controller 150 may output the rotational speed command indicating "0" (zero), to the first drive circuit 119, and the first drive circuit 119 may not supply the drive current to the first drive motor 111. Although the first drive motor 111 does not drive the pulsator 40, the pulsator 40 may be rotated in the second rotation direction that is the same as the rotational direction of the drum 30 due to the rotation of the drum 30.

The main controller 150 may record the driving time of the drum 30 during the drum 30 is driven, and when the driving time is greater than the first period of time (T1), the main controller 150 may stop the drive of the drum 30.

The washing apparatus 1 may stop the drive of the drum 30 (operation 1440).

The main controller 150 may control the second drive device 130 so that the drive of the drum 30 is stopped for the second period of time (T2). The second drive device 130 may still not drive the pulsator 40. As a result, the rotation of the drum 30 and the pulsator 40 may be stopped for the second period of time (T2).

The washing apparatus 1 may drive the drum 30 to be rotated in the first rotational direction.

As mentioned above, during the second washing (operation 1014) and/or the rinsing (operation 1022), the washing apparatus 1 may control the second drive device 130 so that the drum 30 is repeatedly rotated in the first rotational direction and the second rotational direction, and may control the first drive device 110 so that the pulsator 40 is not driven.

By the rotation of the drum 30, the laundry may be dropped from the upper side to the lower side of the drum 30 and then the laundry may be washed by the drop. In addition, since the pulsator 40 is not driven, the pulsator 40 may be rotated in the same direction as the rotational direction of the drum 30 and thus the twisted laundry may be untwisted.

Accordingly, since the drum 30 and the pulsator 40 are provided, and the twisted laundry is untwisted when the drum 30 and the pulsator 40 are rotated in the same direction, it may be possible to reduce the unbalance of the laundry during the intermediate spin-dry (operation 1016 and operation 1024) that is performed later.

The above mentioned operation (operation 1400) may be performed in not only the second washing (operation 1014) of the washing cycle (operation 1010), but also in the rinsing (operation 1022) of the rinsing cycle (operation 1020).

Figure 19:
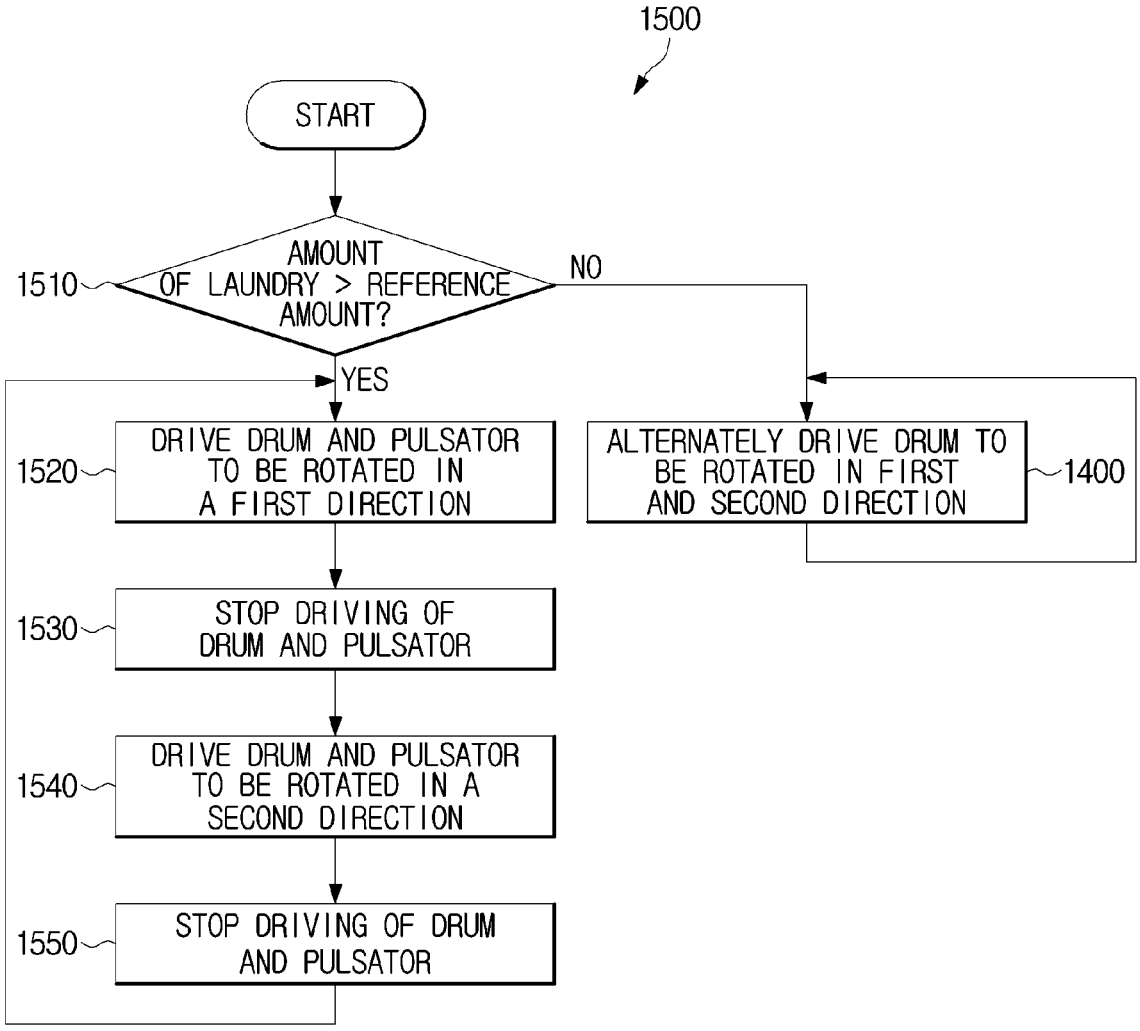
FIG. 19 is a view illustrating another example of the second washing operation and the rinsing operation of the washing apparatus in accordance with an embodiment.
Figure 20:
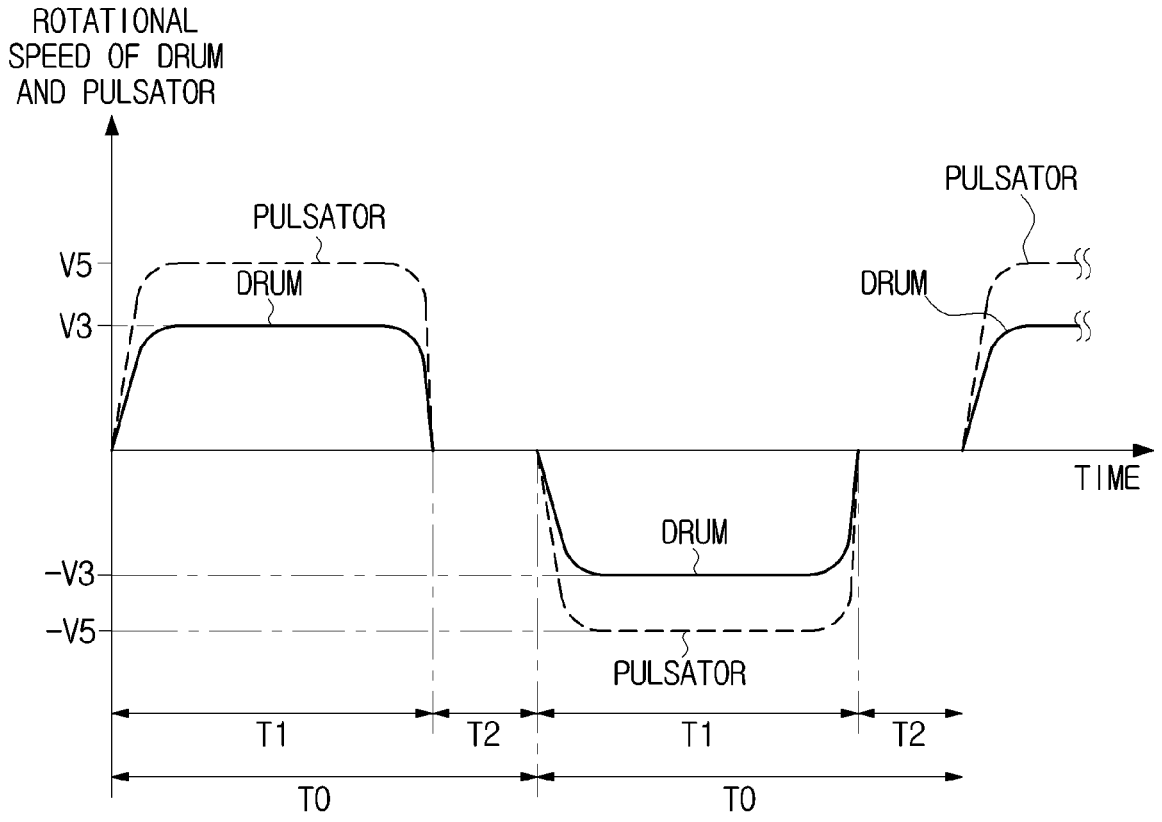
FIG. 20 is a view illustrating the rotation of the drum and the pulsator by the second washing operation and the rinsing operation shown in FIG. 19.

FIG. 19 is a view illustrating another example of the second washing operation and the rinsing operation of the washing apparatus in accordance with an embodiment. FIG. 20 is a view illustrating the rotation of the drum and the pulsator by the second washing operation and the rinsing operation shown in FIG. 19.

A second washing operation (operation 1500) of the washing apparatus 1 will be described with reference to FIGS. 19 and 20. A rinsing operation of the washing apparatus 1 may be the same as the second washing operation (operation 1500).

The washing apparatus 1 may determine whether an amount of laundry is greater than a reference amount (operation 1510).

The washing apparatus 1 may measure the amount of the laundry.

For example, the washing apparatus 1 may perform measuring the laundry prior to the supply of water (operation 1012) of the washing cycle (operation 1010). The main controller 150 may control the second drive device 130 so that the drum 30 is rotated in the forward or reverse direction, and measure the second drive current value supplied to the second drive motor 131. The main controller 150 may estimate the amount of the laundry based on the second drive current value, and store the estimated amount of the laundry.

During the supply of water (operation 1012) of the washing cycle (operation 1010) and/or the supply of water (operation 1021) of the rinsing cycle (operation 1020), the washing apparatus 1 may measure the amount of the laundry and store the estimated amount of the laundry.

The main controller 150 may compare the amount of the laundry, which is pre-stored, with a reference amount, and determine whether the amount of the laundry is greater than the reference amount.

When the amount of the laundry is not greater than the reference amount (No in 1510), the washing apparatus 1 may drive the drum 30 to be rotated in the first direction and/or the second direction.

For the second washing (operation 1014) and the rinsing (operation 1022), the washing apparatus 1 may perform the second washing operation (operation 1400) as illustrated in FIGS. 17 and 18.

When the amount of the laundry is greater than the reference amount (Yes in operation 1510), the washing apparatus 1 may drive both of the drum 30 and the pulsator 40 to be rotated in the first direction (operation 1520).

The main controller 150 may control the second drive device 130 and the first drive device 110 so that the second drive device 130 and the first drive device 110 rotate the drum 30 and the pulsator 40 in the first rotational direction for the first period of time (T1).

For example, the main controller 150 may output the rotational speed command indicating the first rotational direction and the first rotational speed, to the second drive circuit 139. The second drive circuit 139 may supply the second drive current to the second drive motor 131 so that the second drive motor 131 is rotated in the first rotational direction at the first rotational speed. The rotational force of the second drive motor 131 may be transmitted to the second shaft 133 through the second belt 137 and the second pulley 135 as being reduced. As a result, as illustrated in FIG. 20, the drum 30 may be rotated in the first rotational direction at the third rotational speed (V3) for the first period of time (T1).

The main controller 150 may output the rotational speed command indicating the first rotational direction and the second rotational speed, to the first drive circuit 119. The first drive circuit 119 may supply the first drive current to the first drive motor 111 so that the first drive motor 111 is rotated in the first rotational direction at the second rotational speed. The rotational force of the first drive motor 111 may be transmitted to the first shaft 113 through the first belt 117 and the first pulley 115, as being reduced. As a result, the pulsator 40 may be rotated in the first rotational direction at a fifth rotational speed (V5) for the first period of time (T1).

The main controller 150 may record a driving time of the drum 30 and the pulsator 40 during the drum 30 and the pulsator 40 are driven, and when the driving time of the drum 30 and the pulsator 40 is longer than the first period of time (T1), the main controller 150 may stop the drive of the drum 30 and the pulsator 40.

In this time, the fifth rotational speed (V5) of the pulsator 40 may be greater than the third rotational speed (V3) of the drum 30. When a diameter of the first pulley 115 is the same as a diameter of the second pulley 135, the first rotational speed (V1) of the first drive motor 111 may be greater than the second rotational speed (V2) of the second drive motor 131.

During the first washing (operation 1013), the washing apparatus 1 may rotate the drum 30 and the pulsator 40 in different direction from each other to improve the washing performance, but the laundry in the drum 30 may be twisted.

During the second washing (operation 1014) and/or the rinsing (operation 1022), the washing apparatus 1 may untwist the twisted laundry while washing the laundry. When the amount of the laundry is small, the washing apparatus 1 may drive the drum 30 to be rotated as illustrated in FIGS. 17 and 18.

However, when the amount of the laundry is large (e.g., the amount of the laundry is greater than the reference amount), it may be difficult to sufficiently untwist the twisted laundry through the rotation of the drum 30. Therefore, in order to sufficiently untwist the twisted laundry, the washing apparatus 1 may drive the pulsator 40 and the drum 30 to be rotated in the same direction. Particularly, the washing apparatus 1 may drive the pulsator 40 and the drum 30 so that the pulsator 40 is rotated at a rotational speed that is faster than a rotational speed of the drum 30.

The washing apparatus 1 may stop the drive of the drum 30 and the pulsator 40 (operation 1530).

The main controller 150 may control the second drive device 130 and the first drive device 110 so that the drive of the drum 30 and the pulsator 40 are stopped for the second period of time (T2).

For example, the main controller 150 may output the rotational speed command indicating "0" (zero), to the second drive circuit 139 and the first drive circuit 119, and the second drive circuit 139 and the first drive circuit 119 each may not supply the drive current to the second drive motor 131 and the first drive motor 111. As a result, the rotation of the drum 30 and the pulsator 40 may be stopped for the second period of time (T2).

The main controller 150 may record the stop driving time of the drum 30 and the pulsator 40 and when the stop driving time is longer than the second period of time (T2), the main controller 150 may start the drive of the drum 30 and the pulsator 40.

The washing apparatus 1 may drive the drum 30 and the pulsator 40 to be rotated in the second rotational direction (operation 1540).

The main controller 150 may control the second drive device 130 and the first drive device 110 so that the drum 30 and the pulsator 40 are rotated in the second rotational direction for the first period of time (T1). As a result, as illustrated in FIG. 20, the drum 30 may be rotated in the second rotational direction at the third rotational speed (V3) for the first period of time (T1), and the pulsator 40 may be rotated in the second rotational direction at the fifth rotational speed (V5) for the first period of time (T1).

The main controller 150 may record the driving time in which both of the drum 30 and the pulsator 40 are driven, and when the driving time of the drum 30 and the pulsator 40 is longer than the first period of time (T1), the main controller 150 may stop the drive of the drum 30 and the pulsator 40.

The washing apparatus 1 may stop the drive of the drum 30 and the pulsator 40 (operation 1550).

The main controller 150 may control the second drive device 130 and the first drive device 110 so that the drive of the drum 30 and the pulsator 40 are stopped for the second period of time (T2). As a result, the rotation of the drum 30 and the pulsator 40 may be stopped for the second period of time (T2).

The washing apparatus 1 may drive the drum 30 and the pulsator 40 to be rotated in the first rotational direction.

As mentioned above, during the second washing (operation 1014) and/or the rinsing (operation 1022), the washing apparatus 1 may control the second drive device 130 and the first drive device 110 so that the drum 30 and the pulsator 40 are repeatedly rotated in the first rotational direction and the second rotational direction. In addition, the sum of the first period of time (T1) in which the drum 30 and the pulsator 40 are driven and the second period of time (T2) in which the drum 30 and the pulsator 40 are not driven, may be the same as an operation period (T0) in which the drum 30 and the pulsator 40 repeatedly performs the rotation.

By the rotation of the drum 30, the laundry may be dropped from the upper side to the lower side of the drum 30, and the laundry may be washed or rinsed by the drop. In addition, since the pulsator 40 is rotated in the direction the same as the direction of the drum 30, the twisted laundry may be untwisted.

Accordingly, since the drum 30 and the pulsator 40 are provided, and the twisted laundry is untwisted when the drum 30 and the pulsator 40 are rotated in the same direction, it may be possible to reduce the unbalance of the laundry during the intermediate spin-dry (operation 1016 and operation 1024) that is performed later.

The above mentioned operation (operation 1500) may be performed in not only the second washing (operation 1014) of the washing cycle, but also in the rinsing (operation 1022) of the rinsing cycle (operation 1020).

As is apparent from the above description, a front loading washing apparatus is provided a drum and a pulsator.

A washing apparatus is configured to prevent the overload of a motor driving a drum and a motor driving a pulsator.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While exemplary embodiments have been described with respect to a limited number of embodiments, those skilled in the art, having the benefit of this disclosure, will appreciate that other embodiments can be devised that do not depart from the scope as disclosed herein. Accordingly, the scope should be limited only by the attached claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A washing apparatus comprising:

a drum configured to be rotatable;

a pulsator configured to be rotatable inside of the drum;

a drum drive motor configured to rotate the drum in a first direction and a second direction opposite of the first direction;

a pulsator drive motor configured to rotate the pulsator in the first direction and the second direction; and a controller configured to:

control the drum drive motor to rotate the drum in the first direction and control the pulsator drive motor to rotate the pulsator in the second direction, during rotating the drum in the first direction and the pulsator in the second direction, determine whether a first time period is expired from a start of the rotating of the drum in the first direction and the pulsator in the second direction, in response to the controller determining that the first time period is expired, determine whether a drum drive current value, which is supplied to the drum drive motor, is greater than a first reference current value and determine whether a pulsator drive current value, which is supplied to the pulsator drive motor, is greater than a second reference current value, in response to the controller determining that the drum drive current value is greater than the first reference current value prior to a second time period from the start of the rotating of the drum in the first direction and the pulsator in the second direction being expired, control the drum drive motor to stop rotating the drum in the first direction and control the pulsator drive motor to stop rotating the pulsator in the second direction, in response to the controller determining that the pulsator drive current value is greater than the second reference current value prior to the second time period from the start of the rotating of the drum in the first direction and the pulsator in the second direction being expired, control the drum drive motor to continue rotating the drum in the first direction and control the pulsator drive motor to stop rotating the pulsator in the second direction, determining whether the second time period is expired, and in response to the controller determining that the second time period is expired, control the drum drive motor to rotate the drum in the second direction and control the pulsator drive motor to rotate the pulsator in the first direction.

* * * * *